United States Patent [19]

Sakurai et al.

[11] Patent Number: 5,072,155

[45] Date of Patent: Dec. 10, 1991

[54] RARE GAS DISCHARGE FLUORESCENT LAMP DEVICE

[75] Inventors: Takehiko Sakurai; Takeo Saikatsu; Yoshinori Anzai; Hiroyoshi Yamazaki, all of Kanagawa, Japan

[73] Assignee: Mitsubishi Denki Kabushiki Kaisha, Tokyo, Japan

[21] Appl. No.: 525,962

[22] Filed: May 11, 1990

[30] Foreign Application Priority Data

| | | | |
|---|---|---|---|
| May 22, 1989 | [JP] | Japan | 1-128511 |
| May 26, 1989 | [JP] | Japan | 1-134114 |
| Sep. 5, 1989 | [JP] | Japan | 1-229647 |
| Sep. 5, 1989 | [JP] | Japan | 1-229648 |

[51] Int. Cl.[5] ..... H05B 41/36

[52] U.S. Cl. ..... 315/219; 315/209 R; 315/307; 315/DIG. 7; 313/576; 313/642

[58] Field of Search ..... 315/219, 224, 209 R, 315/307, 200 R, 207, 283, 326, 358, DIG. 2, DIG. 5, DIG. 7; 313/572, 573, 576, 641, 642

[56] References Cited

U.S. PATENT DOCUMENTS

| | | | |
|---|---|---|---|
| 3,745,411 | 7/1973 | Polman et al. | 315/209 R |
| 4,899,090 | 2/1990 | Yoshiike et al. | 313/572 X |

*Primary Examiner*—Eugene R. Laroche
*Assistant Examiner*—Ali Neyzari
*Attorney, Agent, or Firm*—Burns, Doane, Swecker & Mathis

[57] ABSTRACT

The invention provides a rare gas discharge fluorescent lamp device which is long in life and high in brightness and efficiency. The lamp device comprises a rare gas discharge fluorescent lamp including a glass bulb having xenon, argon or krypton gas enclosed therein, a fluorescent layer formed on an inner face of the bulb, and a pair of electrodes located at the opposite ends of the bulb. A pulse-like voltage wherein the ratio of an energization period with respect to one cycle is higher than 5% but lower than 70% (xenon or krypton gas) or 80% (argon gas) and the energization period is shorter than 150 μsec is applied between the electrodes of the lamp. Such pulse-like voltage is produced from a circuit including a dc power source, a pulse signal source, and a switching element for controlling application of a voltage of the dc power source or such voltage boosted by a boosting transformer or a resonance circuit. Where the negative electrode includes a filament coil, a rectifying element is connected between the electrodes of the lamp for allowing pre-heating of the filament coil.

27 Claims, 21 Drawing Sheets

RARE GAS DISCHARGE FLUORESCENT LAMP DEVICE

BACKGROUND OF THE INVENTION

1. Field of the Invention

This invention relates to a rare gas discharge fluorescent lamp device for use with an information device such as, for example, a facsimile, a copying machine or an image reader wherein fluorescent substance is excited to emit light by ultraviolet rays generated by rare gas discharge.

2. Description of the Prior Art

In recent years, the performances of information terminal devices such as a facsimile, a copying machine and an image reader have been improved together with advancement of the information-oriented society, and the market of such information devices is rapidly expanding. In developing information devices of a higher performance, a light source unit for use with such information devices is required to have a higher performance as a key device thereof. Conventionally, halogen lamps and fluorescent lamps have been employed frequently as lamps for use with such light source units. However, since halogen lamps are comparatively low in efficiency, fluorescent lamps which are higher in efficiency are used principally in recent years.

However, while a fluorescent lamp is high in efficiency, it has a problem that characteristics thereof such as the fact that an optical output characteristic vary in accordance with a temperature since discharge from vapor of mercury is utilized for emission of light. Therefore, when a fluorescent substance is used, either the temperature range in use is limited, or a heater is provided on a wall of a tube of the lamp in order to control the temperature of the lamp. However, development of fluorescent lamps having stabilized characteristics are demanded eagerly for diversification of locations for use and for improvement in performance of devices. From such background, development of a rare gas discharge fluorescent lamp which makes use of emission of light based on rare gas discharge and is free from a change in temperature characteristic is being proceeded as a light source for an information device.

FIGS. 25 and 26 show an exemplary one of conventional rare gas discharge fluorescent lamp devices which is disclosed, for example, in Japanese Patent Laid-Open No. 63-58752 and wherein FIG. 25 is a diagrammatic representation showing a longitudinal section of a rare gas discharge fluorescent lamp and an entire construction of the device, and FIG. 26 is a cross sectional view of the lamp. Referring to FIGS. 25 and 26, the rare gas discharge fluorescent lamp of the device shown includes a bulb 101 in the form of an elongated hollow rod or tube which may be made of quartz or hard or soft glass. A fluorescent coating 102 is formed on an inner face of the bulb 101, and rare gas consisting at least one of xenon, krypton, argon, neon and helium gas is enclosed in the bulb 101. A pair of inner electrodes 103*a* and 103*b* having the opposite polarities to each other are located at the opposite longitudinal end portions within the bulb 101. The inner electrodes 103*a* and 103*b* are connected to a pair of lead wires 104*a* and 104*b*, respectively, which extend in an airtight condition through the opposite end walls of the bulb 101. An outer electrode 105 in the form of a belt may be provided on an outer face of a side wall of the bulb 101 and extends in parallel to the axis of the bulb 101.

The inner electrodes 103*a* and 103*b* are connected by way of the lead wires 104*a* and 104*b*, respectively, to a high frequency invertor 108 serving as a high frequency power generating device, and the high frequency invertor 108 is connected to a dc power source 109. The outer electrode 105 is connected to the high frequency invertor 108 such that it may have the same polarity as the inner electrode 103*a*.

Operation of the rare gas discharge fluorescent lamp device is described subsequently. With the rare gas discharge fluorescent lamp device having such a construction as described above, when a dc voltage is supplied from the dc power source 109 to the high frequency invertor 108, a high frequency power is produced from the high frequency invertor 108. When the high frequency power is applied across the inner electrodes 103*a* and 103*b* by way of the high frequency invertor 108, glow discharge will take place between the inner electrodes 103*a* and 103*b*. The glow discharge will excite the rare gas within the bulb 101 so that the rare gas will emit peculiar ultraviolet rays therefrom. The ultraviolet rays will excite the fluorescent coating 102 formed on the inner face of the bulb 101. Consequently, visible rays of light are emitted from the fluorescent coating 102 and radiated to the outside of the bulb 101.

Another rare gas discharge fluorescent lamp is disclosed, for example, in Japanese Patent Laid-Open No. 63-248050. The lamp employs such a hot cathode electrode as disclosed, for example, in Japanese Patent Publication No. 63-29931 in order to eliminate the drawback of a cold cathode rare gas discharge lamp that the starting voltage is comparatively high. Such rare gas discharge fluorescent lamp, which includes a pair of electrodes in the form of filament coils, can provide a comparatively high output power because its power load can be increased. Besides, since it does not use mercury, it is advantageous in that the characteristic thereof does not present a variation with respect to temperature which arises from temperature dependency of a pressure of mercury. However, it can attain only a considerably low efficiency and optical output as compared with a fluorescent lamp based on mercury vapor. Further, such cold cathode type lamp requires a power source for heating filament coils of the electrodes.

In summary, conventional rare gas discharge fluorescent lamps cannot attain a sufficiently high brightness or efficiency as compared with fluorescent lamps employing mercury vapor because fluorescent substance is excited to emit light by ultraviolet rays generated by rare gas discharge. Accordingly, improvement in efficiency of rare gas discharge fluorescent lamps is demanded.

SUMMARY OF THE INVENTION

It is an object of the present invention to provide a rare gas discharge fluorescent lamp device which is high in brightness and efficiency.

In order to attain the object, according to one aspect of the present invention, there is provided a rare gas discharge fluorescent lamp device which comprises a rare gas discharge fluorescent lamp including a glass bulb having xenon gas or krypton gas enclosed therein, a fluorescent layer formed on an inner face of the glass bulb, and a pair of electrodes located at the opposite ends of the glass bulb, and a pulse-like voltage generating source for applying between the pair of electrodes of the rare gas discharge fluorescent lamp a pulse-like voltage wherein the ratio of an energization period with respect to one cycle is higher than 5% but lower than 70% and the energization period is shorter than 150 μsec, the pulse-like voltage generating source including a dc power source, a boosting transformer including a secondary coil connected between the pair of electrodes of the rare gas discharge fluorescent lamp and a primary coil having one of the opposite ends thereof to one of the opposite ends of the dc power source, a switching element connected between the other end of the primary coil of the boosting transformer and the other end of the dc power source, and controlling means for controlling the switching element between a conducting state and a nonconducting state. Xenon gas or krypton gas may be replaced by argon gas while a pulse-like voltage wherein the ratio of an energization period with respect to one cycle is higher than 5% but lower than 80% and the energization period is shorter than 150 μsec is applied between the pair of electrodes of the rare gas discharge fluorescent lamp.

With the rare gas discharge fluorescent lamp device, such a specific pulse-like voltage as described above is supplied between the electrodes of the rare gas discharge fluorescent lamp. Consequently, the probability that molecules of the rare gas may be excited at an energy level at which the rare gas produces a maximum amount of resonance ultraviolet rays which contribute to emission of visible rays of light is increased to assure a high brightness and a high efficiency of the device while wear of the electrodes is reduced.

According to another aspect of the present invention, there is provided a rare gas discharge fluorescent lamp device which comprises a rare gas discharge fluorescent lamp including a glass bulb having xenon gas or krypton gas enclosed therein, a fluorescent layer formed on an inner face of the glass bulb, and a pair of electrodes located at the opposite ends of the glass bulb and serving as a negative electrode and a positive electrode, at least the negative electrode of the electrodes being formed from a filament coil, a series circuit including a dc power source and a current limiting element connected between the positive electrode of the rare gas discharge fluorescent lamp and one of the opposite ends of the filament coil of the negative electrode, a switching element connected between the positive electrode of the rare gas discharge fluorescent lamp and the other end of the filament coil of the negative electrode, and a pulse signal source for applying to the switching element a pulse signal to open the switching element for a period of time shorter than 150 μsec for each cycle at a ratio higher than 5% but lower than 70% with respect to one cycle. Also, xenon gas or krypton gas may be replaced by argon gas while a pulse-like voltage wherein the ratio of an energization period with respect to one cycle is higher than 5% but lower than 80% and the energization period is shorter than 150 μsec is applied between the pair of electrodes of the rare gas discharge fluorescent lamp.

With the rare gas discharge fluorescent lamp device, since the series circuit including the dc power source and the current limiting element is connected between the positive electrode of the rare gas discharge fluorescent lamp and the one end of the filament coil of the negative electrode while the switching element is connected between the positive electrode of the rare gas discharge fluorescent lamp and the other end of the filament coil of the negative electrode, when the switching element is held in a closed state by the pulse signal from the pulse signal source, no voltage is applied across the rare gas discharge fluorescent lamp, and consequently, no discharge takes place in the lamp. In the meantime, the filament coil of the negative electrode is pre-heated by electric current which flows through the switching element by way of the current limiting element. Then, when the switching element is opened subsequently, the rare gas discharge fluorescent lamp discharges. Since such discharge of the rare gas discharge fluorescent lamp by opening of the switching element takes place in the specified condition, the probability that molecules of the rare gas may be excited at an energy level at which the rare gas produces a maximum amount of resonance ultraviolet rays which contribute to emission of visible rays of light is increased to assure a high brightness and a high efficiency of the device while wear of the electrodes is reduced.

According to a further aspect of the present invention, there is provided a rare gas discharge fluorescent lamp device which comprises a rare gas discharge fluorescent lamp including a glass bulb having xenon gas or krypton gas enclosed therein, a fluorescent layer formed on an inner face of the glass bulb, and a pair of electrodes located at the opposite ends of the glass bulb, a series circuit connected between the electrodes of the rare gas discharge fluorescent lamp and including a dc power source and a resonance circuit which includes an inductor and a capacitor, a switching element connected between the electrodes of the rare gas discharge fluorescent lamp, and a pulse signal source for applying to the switching element a pulse signal to open the switching element for a period of time shorter than 150 μsec for each cycle at a ratio higher than 5% but lower than 70% with respect to one cycle. Also, xenon gas or krypton gas may be replaced by argon gas while a pulse-like voltage wherein the ratio of an energization period with respect to one cycle is higher than 5% but lower than 80% and the energization period is shorter than 150 μsec is applied between the pair of electrodes of the rare gas discharge fluorescent lamp.

With the rare gas discharge fluorescent lamp device, since the series circuit including the dc power source and the resonance circuit is connected between the pair of electrodes of the rare gas discharge fluorescent lamp while the switching element is connected between the pair of electrodes, when the switching element is held in a closed state by the pulse signal from the pulse signal source, no voltage is applied across the rare gas discharge fluorescent lamp, and consequently, no discharge takes place in the lamp. Then, when the switching element is opened subsequently, the voltage to be applied between the electrodes of the lamp is boosted to a half-wave rectified ac voltage of a substantially sinusoidal waveform necessary for the lighting of the lamp by the resonance circuit, and consequently, the rare gas discharge fluorescent lamp is caused to discharge by the boosted voltage. Since such discharge of the rare gas discharge fluorescent lamp by opening of the switching element takes place in the specified condition, the probability that molecules of the rare gas may be excited at an energy level at which the rare gas produces a maximum amount of resonance ultraviolet rays which contribute to emission of visible rays of light is increased to assure a high brightness and a high efficiency of the device while wear of the electrodes is reduced.

According to a still further aspect of the present invention, there is provided a rare gas discharge fluorescent lamp device which comprises a tubular glass bulb having a fluorescent layer formed on an inner face thereof and having rare gas enclosed therein, a first electrode provided at an end of the glass bulb, a second electrode provided at the other end of the glass bulb and formed from a filament electrode having a pair of ends, a high frequency power generating source connected between the first electrode and one of the ends of the second electrode, and a rectifying element connected between the first electrode and the other end of the second electrode.

With the rare gas discharge fluorescent lamp device, the high frequency power generating source supplies a high frequency power between the first and second electrodes provided at the opposite ends of the glass bulb, and the rectifying element divides a half wave of the high frequency power to apply a half-wave rectified voltage between the first and second electrodes. Thus, the glass bulb is caused to make pulse-like lighting with a frequency which has energization periods and deenergization periods. Consequently, the rare gas in the bulb is excited efficiently, and a high lamp efficiency can be attained with the rare gas discharge fluorescent lamp device which is simple in construction and low in cost.

The above and other objects, features and advantages of the present invention will become apparent from the following description and the appended claims, taken in conjunction with the accompanying drawings.

DETAILED DESCRIPTION OF THE PREFERRED EMBODIMENTS

In the following, several embodiments of the present invention are described with reference to the accompanying drawings.

Figure 1:
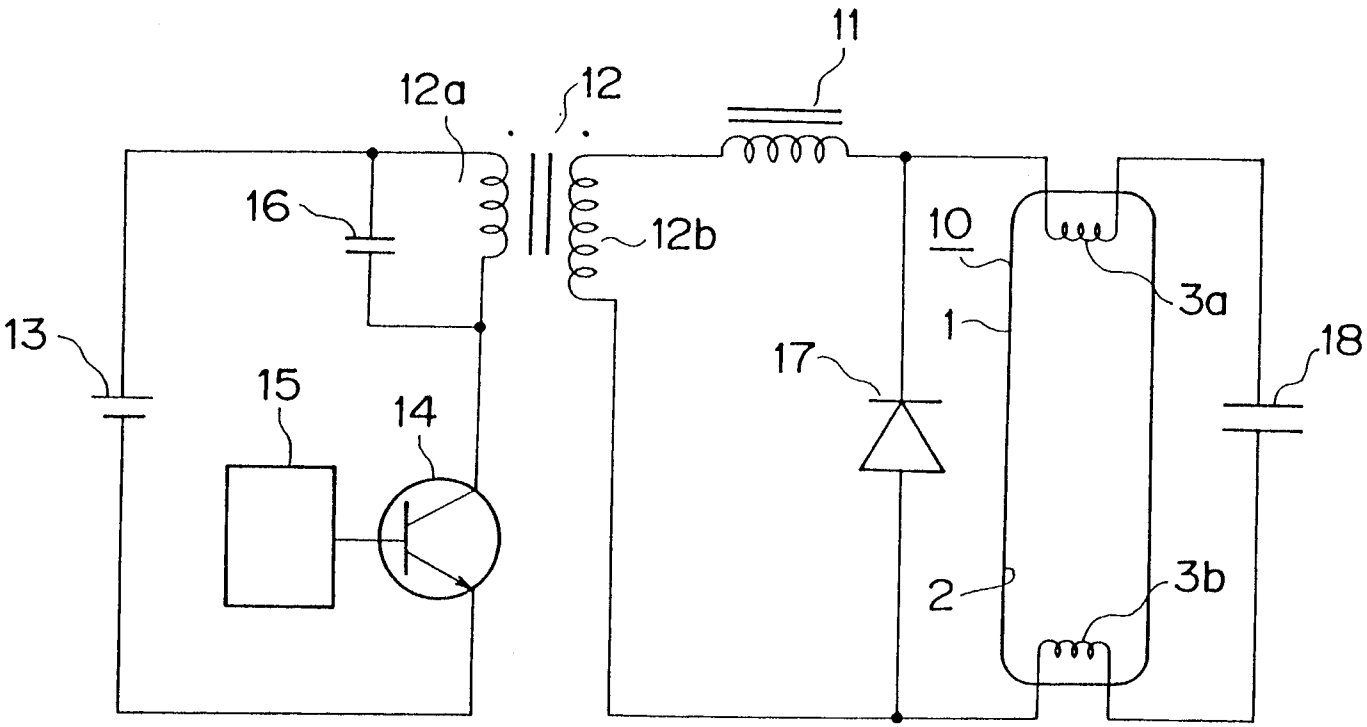
FIG. 1 is a diagrammatic representation of an entire construction of a rare gas discharge fluorescent lamp device showing an embodiment of the present invention.

Referring first to FIG. 1, there is shown an entire construction of a rare gas discharge fluorescent lamp device to which the present invention is applied. The lamp device shown includes a rare gas discharge fluorescent lamp which includes a bulb 1 in the form of a tube made of glass and having an outer diameter of 15.5 mm and an overall axial length of 300 mm. Xenon gas is enclosed at a pressure of 30 Torr in the bulb 1. Though not shown, an auxiliary starting conductor in the form of an aluminum plate having a width of 3 mm is provided in an axial direction on an outer face of the bulb 1. Meanwhile, a fluorescent layer 2 is formed on an inner face of the bulb 1. The lamp further includes a pair of electrodes 3a and 3b each formed from a filament coil to which an electron emitting substance is applied.

The lamp device includes, in addition to the lamp described just above, a current limiting element 11 in the form of an inductor connected at an end thereof to an end of the electrode 3a of the bulb 1. The current limiting element 11 may otherwise be formed from a capacitor. The lamp device further includes a boosting transformer 12 having a primary coil 12a and a secondary coil 12b. The secondary coil 12b is connected at an end thereof to the other end of the current limiting element 11 and at the other end thereof to an end of the other electrode 3b. A dc power source 13 is connected at the positive terminal thereof to an end of the primary coil 12a of the boosting transformer 12. A switching element 14 in the form of a transistor is connected between the negative terminal of the dc power source 13 and the other end of the primary coil 12a of the boosting transformer 12. A controlling device 15 is connected to the switching transistor 14 and serves as a pulse signal source for controlling the switching element 14 between a conducting state and a non-conducting state. In particular, the controlling device 15 delivers a pulse signal to a control electrode (base) of the switching element 14 to control the switching element 14 between a conducting state and a non-conducting state to produce rectangular dc pulses having a frequency of 20 KHz and a duty ratio of 60% (energization period occupies 60%) across the secondary coil 12b of the boosting transformer 12. A resonance capacitor 16 is connected in parallel to the primary coil 12a of the boosting transformer 12 to constitute a resonance circuit. A pulse-like voltage generating source is thus constituted from the current limiting element 11, boosting transformer 12, dc power source 13, switching element 14, controlling device 15 and resonance capacitor 16. A rectifying element 17 in the form of a diode is connected to those ends of the electrodes 3a and 3b which are connected to the secondary coil 12b of the boosting transformer 12. A capacitor 18 is connected to the other ends of the electrodes 3a and 3b of the lamp for allowing preheating of the filament of the electrode 3b which serves as a negative electrode.

Operation of the rare gas discharge fluorescent lamp device having such a construction as described above is now described. First, the controlling device 15 applies to the switching element 14 a pulse signal for controlling the switching element 14 between a conducting state and a non-conducting state. Each pulse of the pulse signal here is a rectangular dc pulse having a duty ratio of 60% and a frequency of 20 KHz. The switching element 14 is repetitively and alternately put into conducting and non-conducting states in response to such dc rectangular pulses. As a result, the voltage of the dc power source 13 is changed into an ac voltage corresponding to the dc rectangular pulses in response to the conducting and non-conducting states of the switching element 14. Such ac voltage appears between the opposite ends of the primary coil 12a of the boosting transformer 12. The ac voltage produced in this manner is applied also across the capacitor 16, and consequently, resonance takes place at the resonance circuit constituted from the primary coil 12a of the boosting transformer 12 and the resonance capacitor 16. The ac voltage is then boosted by the boosting transformer 12, and such boosted voltage appears between the opposite ends of the secondary coil 12b of the boosting transformer 12. The boosted ac voltage is limited by the current limiting element 11, and due to presence of the rectifying element 17, a voltage derived from the boosted ac voltage is applied between the electrodes 3a and 3b of the lamp only when a positive voltage is applied to the electrode 3a. In particular, a high frequency power having a frequency of 20 KHz wherein a period of 60% of one cycle is an energization period and the remaining period is a deenergization or die period is applied to the electrodes 3a and 3b. Thus, during each energization period, glow discharge appears between the electrodes 3a and 3b and excites the xenon gas within the bulb 1 to produce ultraviolet rays peculiar to xenon gas. Such ultraviolet rays are converted into visible rays of light by the fluorescent layer 2 formed on the inner face of the bulb 1 and radiated as irradiation light to the outside of the bulb 1. Thus, discharge in the bulb 1 provides a pulse-like lamp current which has a deenergization or die period therein. Meanwhile, during energization periods, the filament of the electrode 3b which serves as a negative electrode is heated by the current flowing therethrough.

Figure 2:
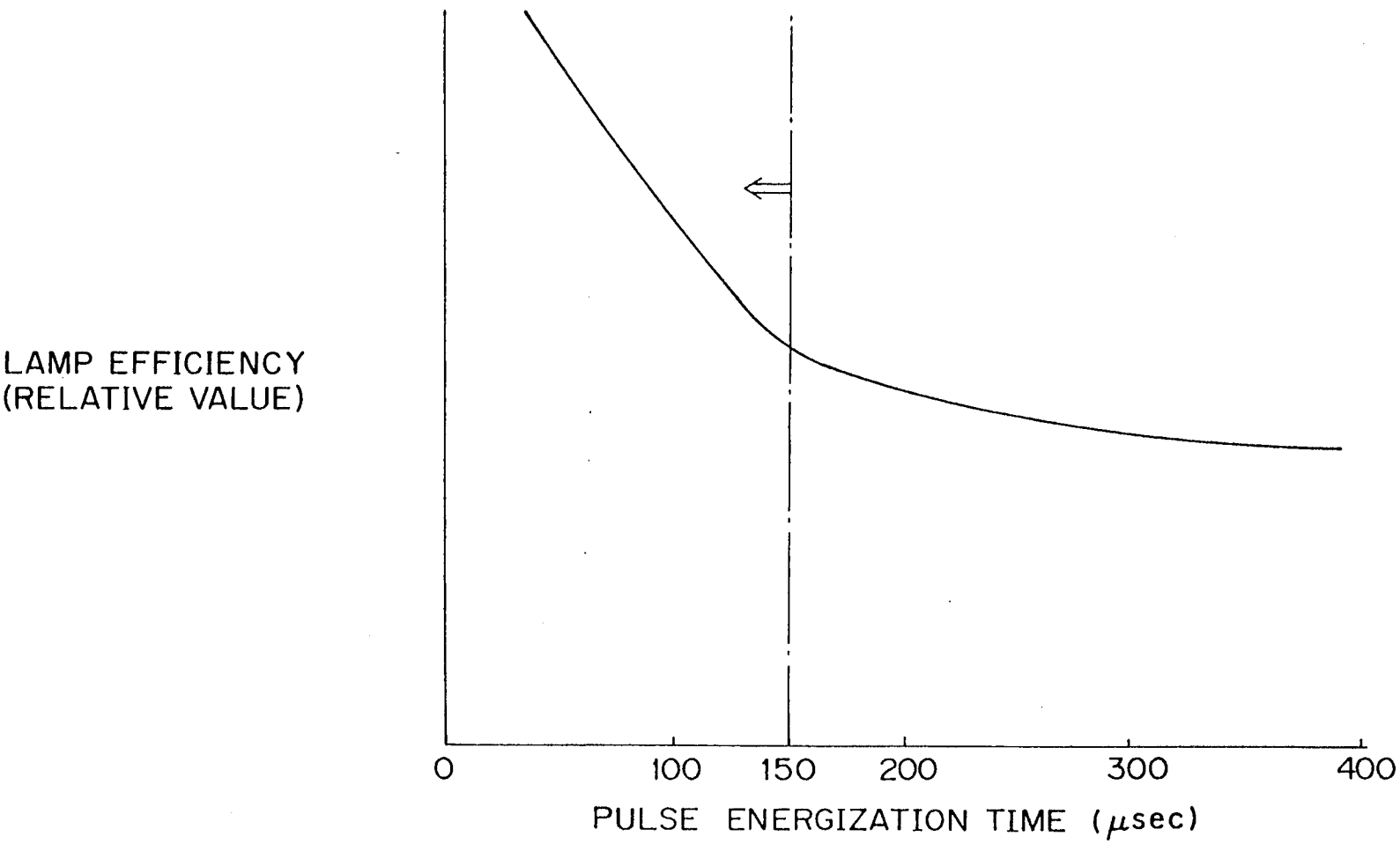
FIG. 2 is a diagram illustrating a relationship of a lamp efficiency to an energization time of a pulse when xenon gas is used with the device shown in FIG. 1.

With the rare gas discharge fluorescent lamp device having the construction described above, an investigation was made of relationships between dc pulse lighting conditions and lamp characteristics. First, several rare gas discharge fluorescent lamp devices were produced wherein the energization period in one cycle was varied to various values while keeping the deenergization period (die period) in one cycle constant at 100 μsec, that is, the pulse signal of the controlling device 15 was varied in various manners, and the relationship between an energization time and a lamp efficiency (a value obtained by dividing a brightness by a power consumption, a relative value) was investigated with the rare gas discharge fluorescent lamp devices. Such results as seen in FIG. 2 were obtained. It is to be noted that the rare gas discharge fluorescent lamp devices had quite similar construction to that of the rare gas discharge fluorescent lamp device described herein above with reference to FIG. 1 except that the controlling device 15 thereof produced a different pulse signal. From FIG. 2, it can be seen that the shorter the pulse energization period, the higher the efficiency, and the effect is particularly remarkable where the pulse energization period is shorter than 150 μsec.

Figure 3:
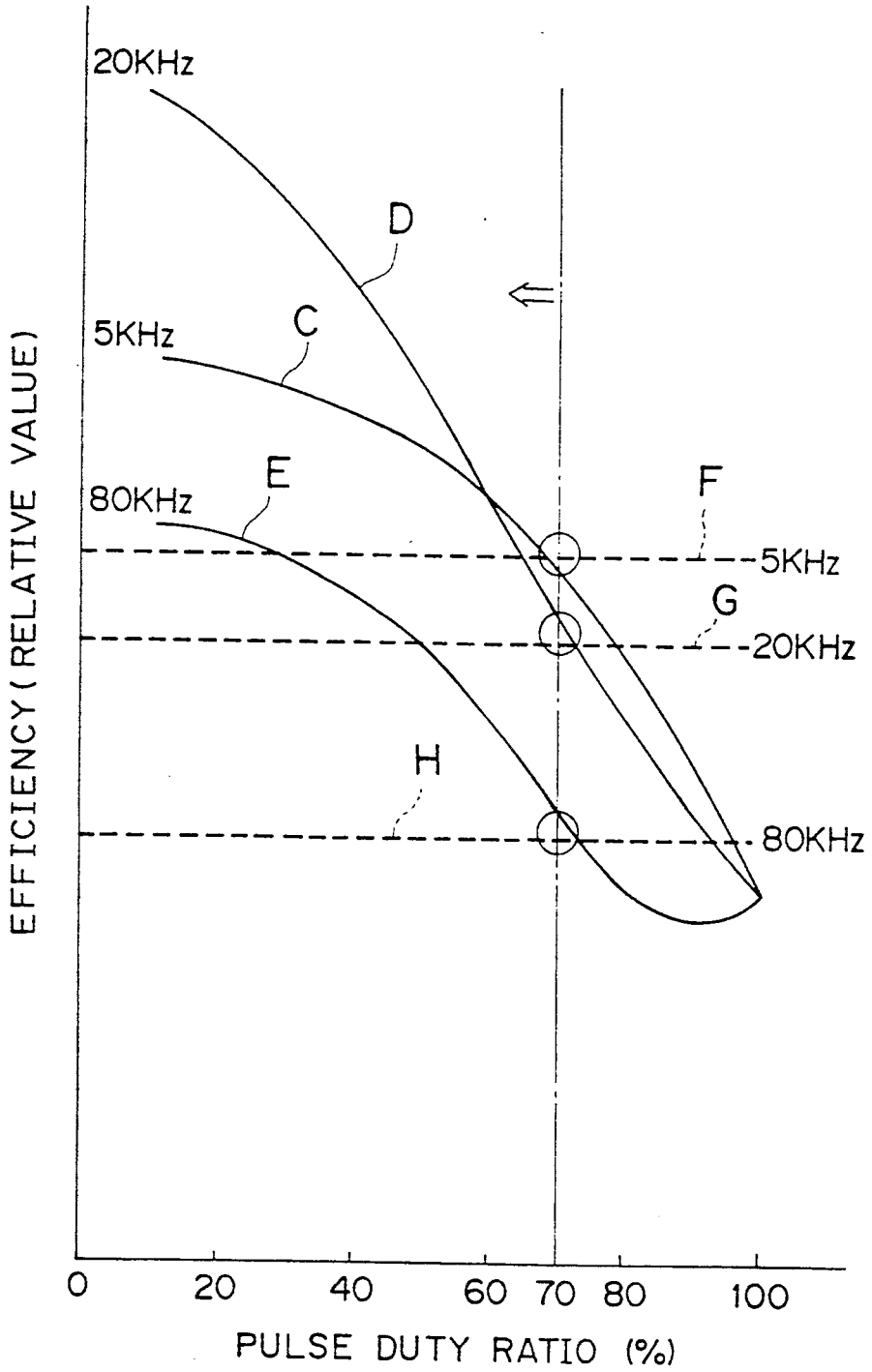
FIG. 3 is a diagram illustrating a relationship of a lamp efficiency to a pulse duty ratio when xenon gas is used with the device shown in FIG. 1.
Figure 25:
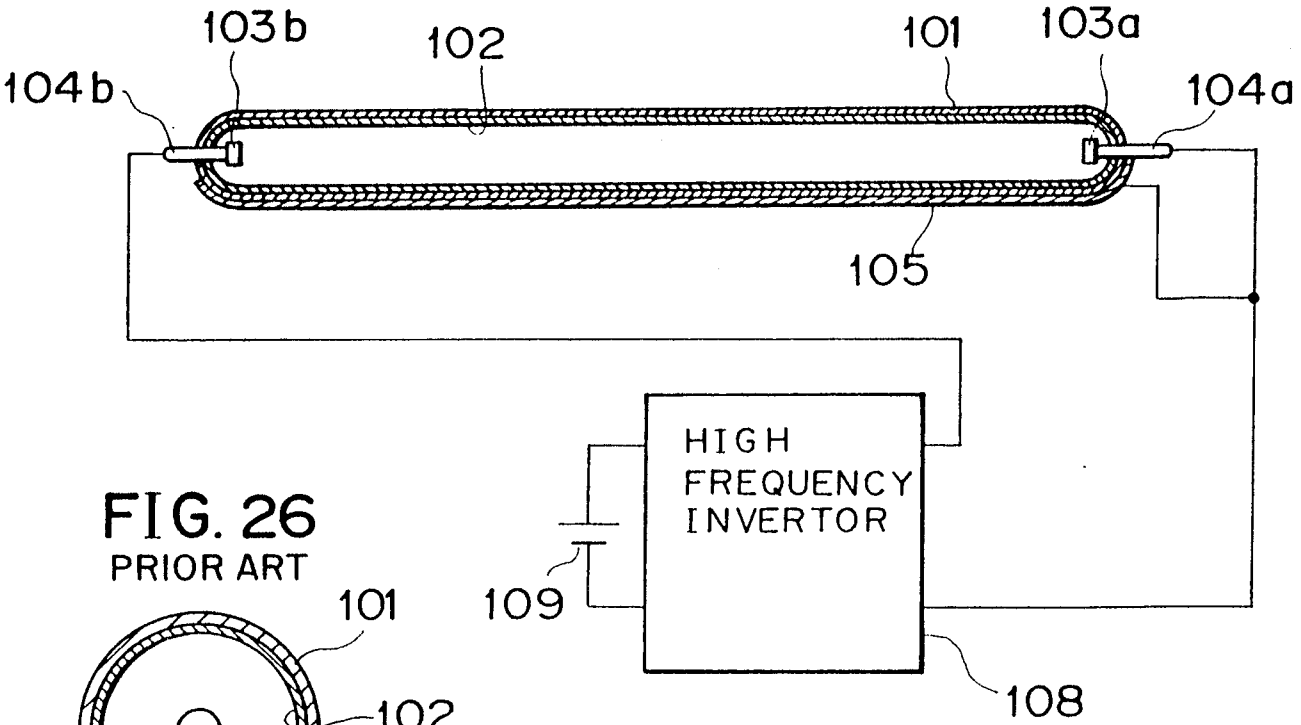
FIG. 25 PRIOR ART
FIG. 25 is a diagrammatic representation showing an entire construction of a conventional rare gas discharge fluorescent lamp device.
Figure 26:
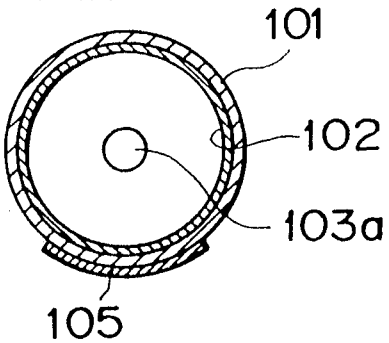
FIG. 26 PRIOR ART
FIG. 26 is an enlarged cross sectional view of a lamp which is employed in the device shown in FIG. 25.

Subsequently, several rare gas discharge fluorescent lamp devices of the same construction as described above were produced wherein the frequency was veried among 5 KHz, 20 KHz and 80 KHz and the duty ratio (a ratio of an energization period with respect to one cycle) was varied to various values, that is, the pulse signal of the controlling device 15 was varied in various manners, and the relationship between a pulse duty ratio and a lamp efficiency (a relative value) was investigated with the rare gas discharge fluorescent lamp devices. Such results as seen in FIG. 3 were obtained. It is to be noted that the rare gas discharge fluorescent lamp devices had quite similar construction to that of the rare gas discharge fluorescent lamp device described hereinabove with reference to FIG. 1 except that the controlling device 15 thereof produced a different pulse signal. It is also to be noted that broken lines F, G and H in FIG. 3 show, for comparison, lamp efficiencies in the case of high frequency ac lighting with sine waves of frequencies of 5 KHz, 20 KHz and 80 KHz, respectively, when a conventional rare gas discharge fluorescent lamp device having such construction as seen in FIG. 25 was used. From FIG. 3, it can be seen that the efficiency is raised significantly by decreasing the duty ratio of pulses as compared with that in dc lighting (duty ratio=100%), and even compared with that in ac lighting at the same frequency, the efficiency is much higher where the pulse duty ratio is lower than 70%.

Figure 4:
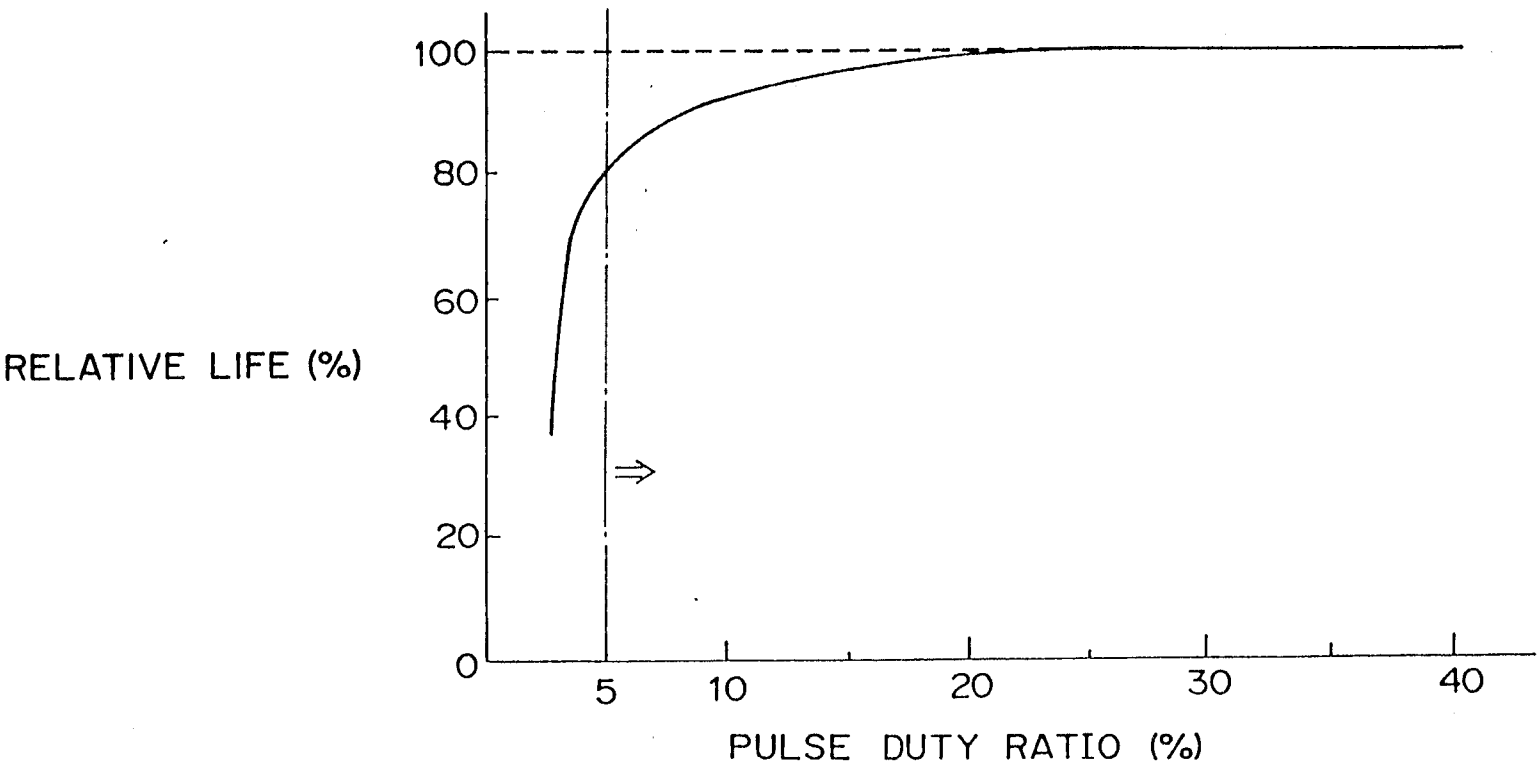
FIG. 4 is a diagram illustrating a relationship of a life to a pulse duty ratio when xenon gas is used with the device shown in FIG. 1.

Further, several rare gas discharge fluorescent lamp devices of the same construction as described above were produced wherein the lamp power was constant and the duty ratio was varied to various values, that is, the pulse signal of the controlling device 15 was varied in various manners, and the relationship between a pulse duty ratio and a relative life was investigated with the rare gas discharge fluorescent lamp devices. Such results as seen in FIG. 4 were obtained. It is to be noted that the terminology "relative life" here signifies a ratio of an average life time when the lamp is lit at a varying duty ratio to an average life time when the lamp is lit at a duty ratio of 40%. Further, the rare gas discharge fluorescent lamp devices had quite similar construction to that of the rare gas discharge fluorescent lamp device described hereinabove with reference to FIG. 1 except that the controlling device 15 thereof produced a different pulse signal. From FIG. 4, it can be seen that, if the pulse duty ratio is reduced until it comes downs to 5%, the relative life exhibits a little decreasing tendency, and after the pulse duty ratio is reduced beyond 5%, the life drops suddenly. It is presumed that, where the duty ratio is lower than 5%, the pulse peak current of the lamp increases so significantly that wear of the electrodes progresses suddenly.

As apparently seen from FIGS. 2, 3 and 4, a rare gas discharge fluorescent lamp device which is high in efficiency and long in life can be obtained by applying between the electrodes 3*a* and 3*d* of the lamp thereof a pulse voltage wherein each cycle has an energization period and a deenergization period and the ratio of the energization period is higher than 5% and lower than 70% while the energization period in each cycle is shorter than 150 μsec.

Figure 5:
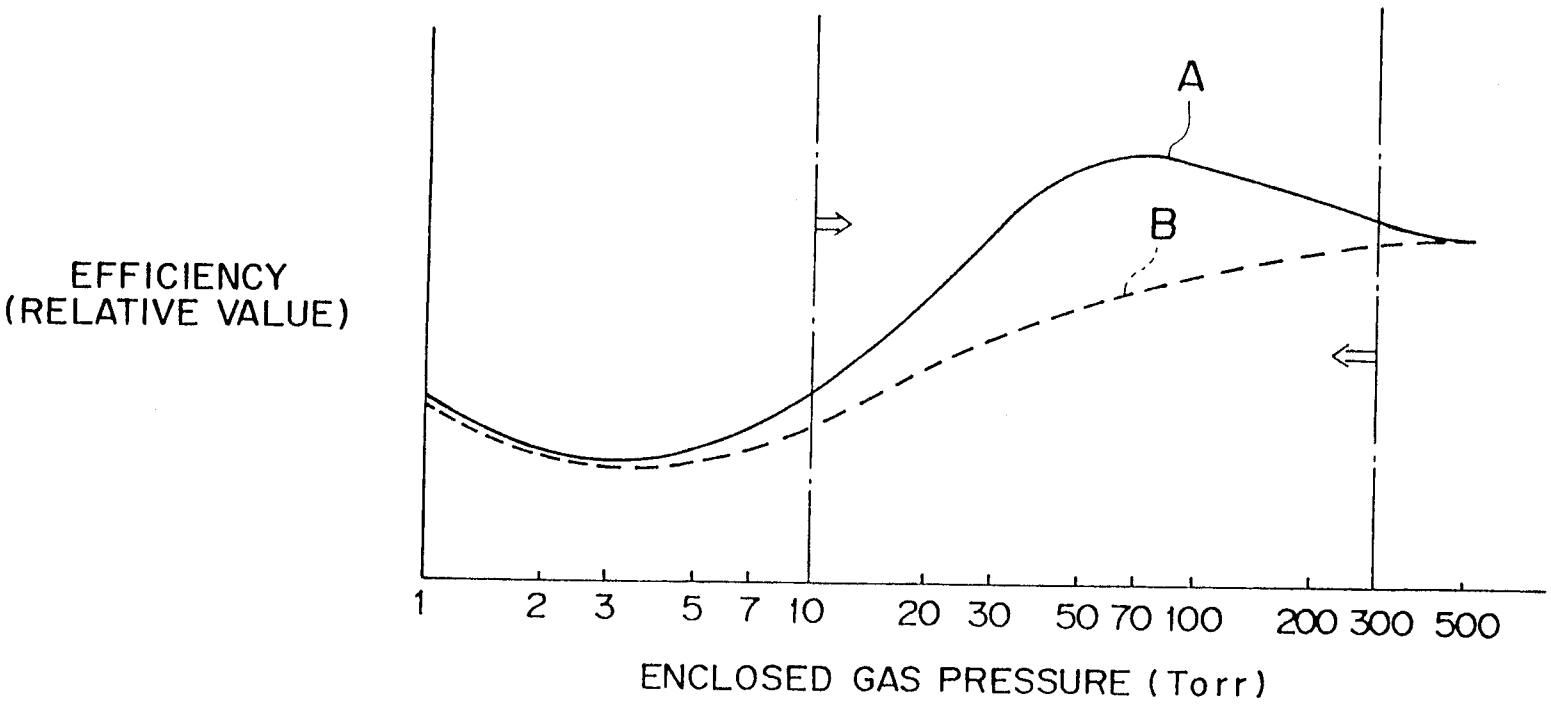
FIG. 5 is a diagram illustrating a relationship of an efficiency to an enclosed gas pressure when xenon gas is used with the device shown in FIG. 1.
Figure 6:
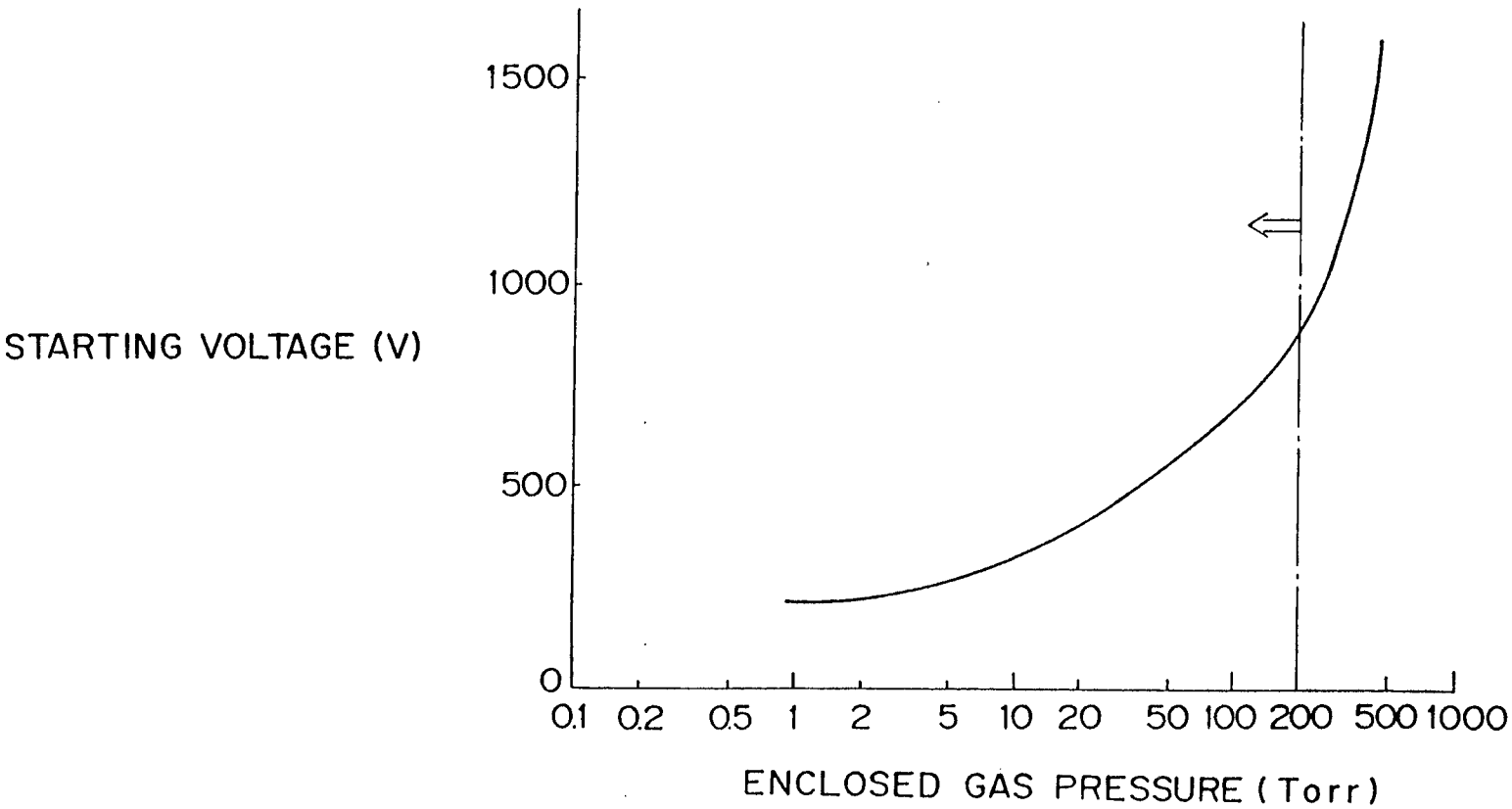
FIG. 6 is a diagram illustrating a relationship of a starting voltage to an enclosed gas pressure when xenon gas is used with the device shown in FIG. 1.

Subsequently, several rare gas discharge fluorescent lamp devices of the same construction as described above were produced wherein the pressure of enclosed xenon gas was varied to various values, and the relationship of a lamp efficiency (relative value) and a starting voltage to a pressure of enclosed xenon gas was investigated with the rare gas discharge fluorescent lamp devices. Such results as shown by a solid line curve A in FIG. 5 and in FIG. 6 were obtained. It is to be noted that the rare gas discharge fluorescent lamp devices had quite similar construction to that of the rare gas discharge fluorescent lamp device described hereinabove with reference to FIG. 1 except that the pressure of enclosed xenon gas was varied. It is also to be noted that a broken line curve B in FIG. 5 shows, for comparison, a result of an investigation of a relationship between a pressure of enclosed xenon gas and a lamp efficiency in the case of high frequency ac lighting with a sine wave of a frequency of 20 KHz when a conventional rare gas discharge fluorescent lamp device having such construction as seen in FIG. 25 was used.

Figure 8:
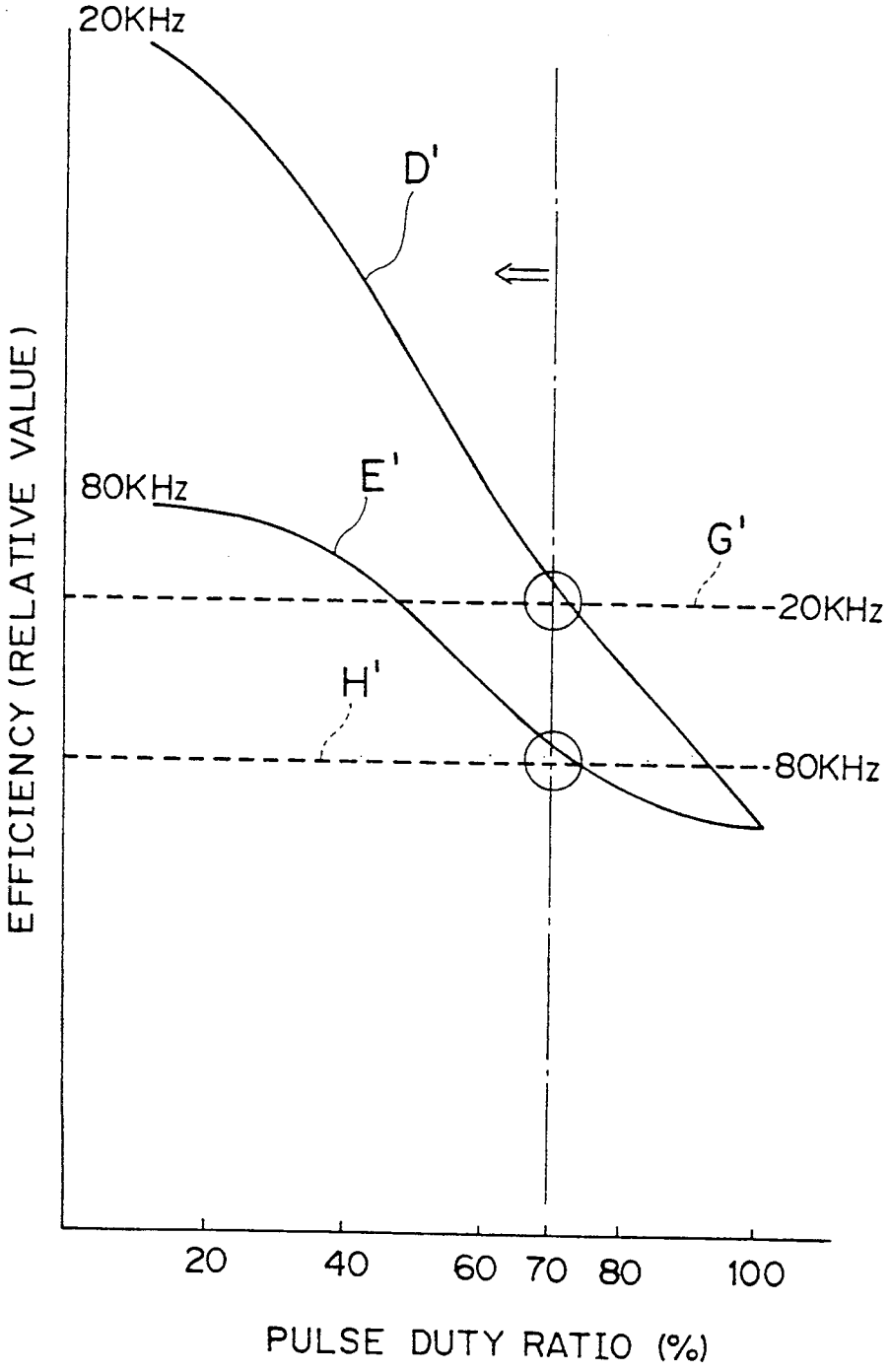
FIG. 8 is a diagram illustrating a relationship of a lamp efficiency to a pulse duty ratio when krypton gas is used with the device shown in FIG. 1.

It can apparently be seen from FIG. 8 that, after the enclosed xenon gas pressure exceeds 5 Torr, the efficiency of the lamp begins to rise and presents a higher value than that of the conventional rare gas discharge fluorescent lamp device. Then, a maximum efficiency is presented within a range of several tens Torr of the enclosed xenon gas pressure, and after the enclosed xenon gas pressure exceeds 300 Torr, the efficiency becomes substantially equal to that of the conventional rare gas discharge fluorescent lamp device. On the other hand, it can be seen from FIG. 6 that, as the enclosed xenon gas pressure increases, the starting voltage rises gradually, and after the enclosed xenon gas pressure exceeds 300 Torr, the starting voltage rises suddenly. Accordingly, the enclosed xenon gas pressure should be higher than 5 Torr but lower than 300 Torr, and preferably higher than 10 Torr but lower than 200 Torr, and most preferably higher than 20 Torr but lower than 150 Torr.

Figure 7:
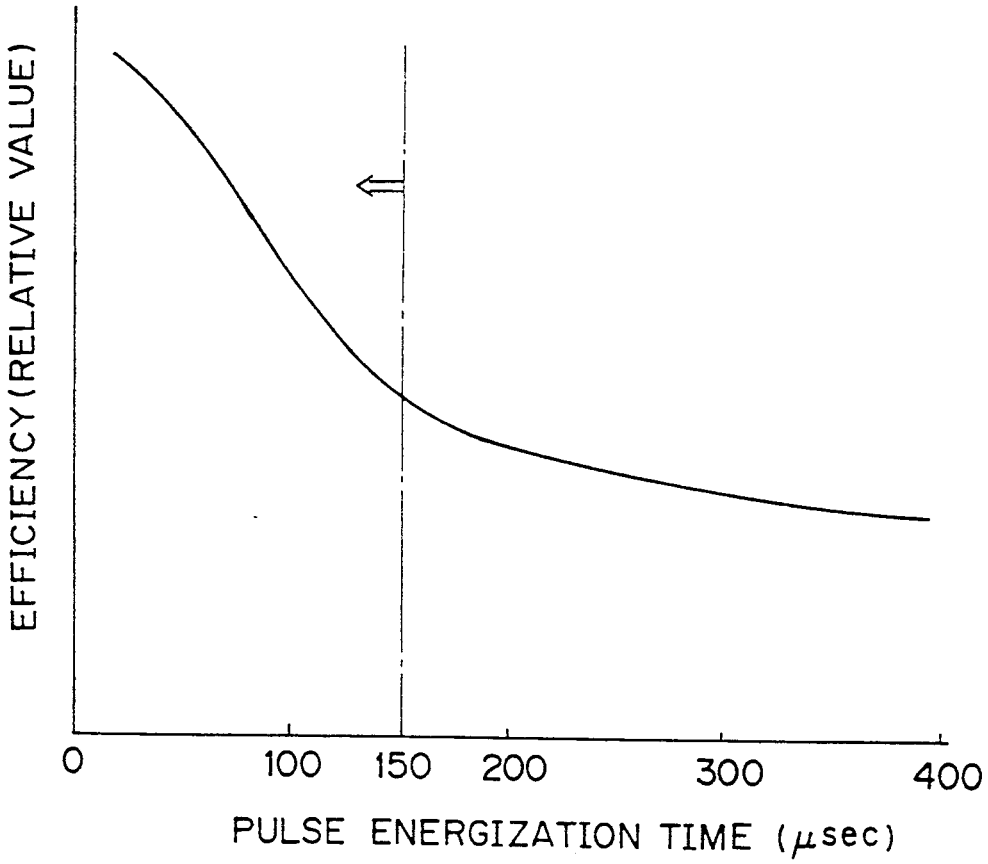
FIG. 7 is a diagram illustrating a relationship of a lamp efficiency to an energization time of a pulse when krypton gas is used with the device shown in FIG. 1.

Further, various rare gas discharge fluorescent lamp devices of the construction described hereinabove were produced wherein krypton gas was enclosed in the lamp in place of xenon gas, and various investigations were made. First, various rare gas discharge fluorescent lamp devices were produced wherein the energization period in one cycle was varied to various values while keeping the deenergization period in one cycle constant at 100 μsec, and the relationship between an energization time and a lamp efficiency was investigated with the rare gas discharge fluorescent lamp devices. Such results as seen in FIG. 7 were obtained. It is to be noted that the rare gas discharge fluorescent lamp devices had quite similar construction to that of the rare gas discharge fluorescent lamp device described hereinabove with reference to FIG. 1 except that the enclosed gas was changed from xenon gas to krypton gas and the controlling device 15 thereof produced a different pulse signal. As apparently seen from FIG. 7, the shorter the pulse energization period, the higher the efficiency, and the effect is particularly remarkable where the pulse energization period is shorter than 150 μsec.

Subsequently, several rare gas discharge fluorescent lamp devices of the same construction as described above were produced wherein the frequencies varied between 20 KHz and 80 KHz and the duty ratio was varied to various values, and the relationship between a pulse duty ratio and a lamp efficiency was investigated with the rare gas discharge fluorescent lamp devices. Such results as shown by solid line curves D' and E' in FIG. 8 were obtained. It is to be noted that the rare gas discharge fluorescent lamp devices had quite similar construction to that of the rare gas discharge fluorescent lamp device described hereinabove with reference to FIG. 1 except that the enclosed gas was changed to krypton and the controlling device 15 thereof produced a different pulse signal. It is also to be noted that broken lines G' and H' in FIG. 8 show, for comparison, lamp efficiencies in the case of high frequency ac lighting with sine waves of frequencies of 20 KHz and 80 KHz, respectively, when a conventional rare gas discharge fluorescent lamp device having such construction as seen in FIG. 25 was used. From FIG. 8, it can be seen that the efficiency is raised significantly by decreasing the duty ratio of pulses as compared with that in dc lighting, and even compared with that in ac lighting at the same frequency, the efficiency is much higher where the pulse duty ratio is lower than 70%.

Figure 9:
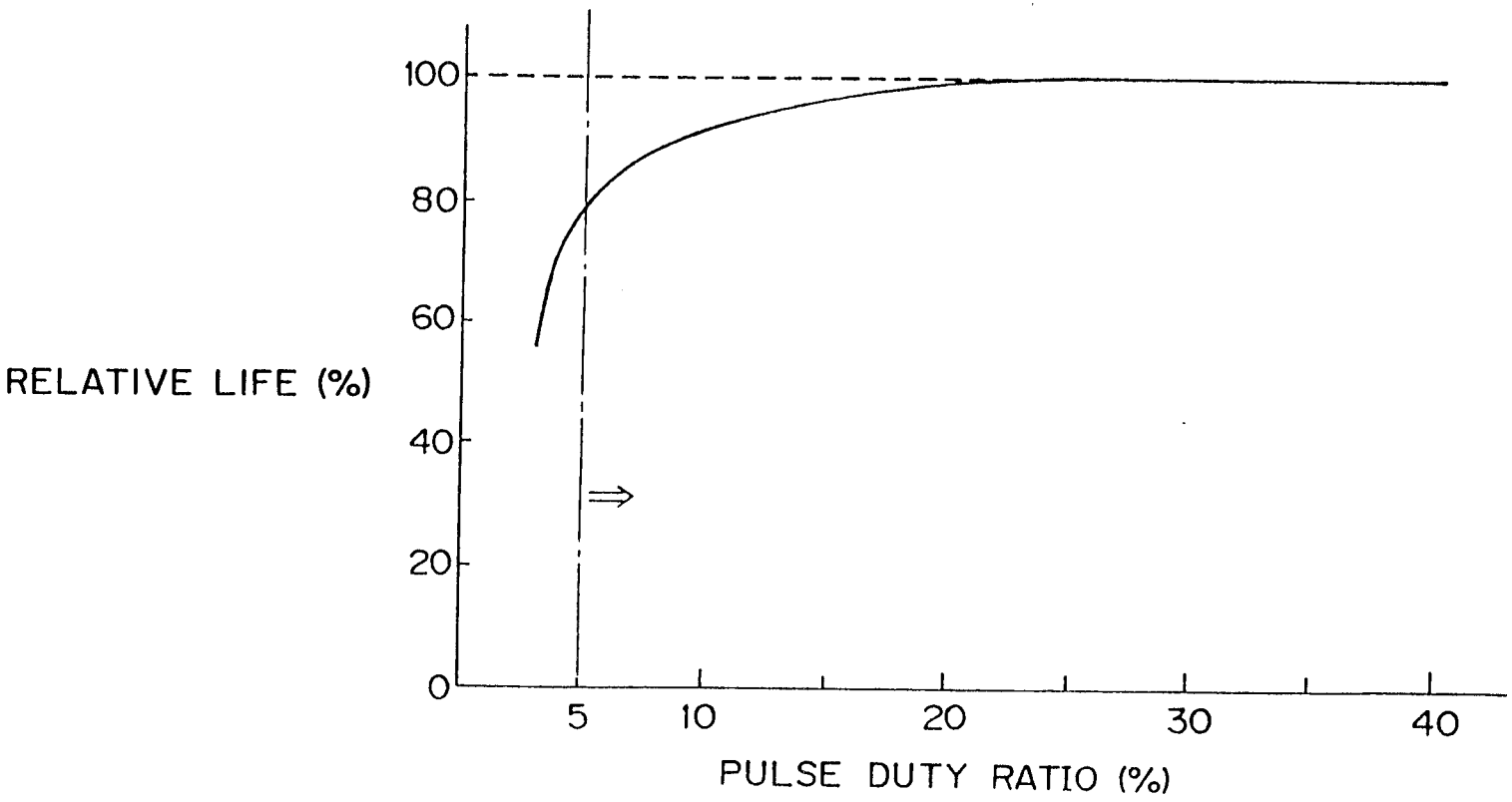
FIG. 9 is a diagram illustrating a relationship of a life to a pulse duty ratio when krypton gas is used with the device shown in FIG. 1.

Further, several rare gas discharge fluorescent lamp devices of the same construction as described above were produced wherein the lamp power was constant and the duty ratio was varied to various values, and the relationship between a pulse duty ratio and a relative life was investigated with the rare gas discharge fluorescent lamp devices. Such results as seen in FIG. 9 were obtained. It is to be noted that the rare gas discharge fluorescent lamp devices had quite similar construction to that of the rare gas discharge fluorescent lamp device described hereinabove with reference to FIG. 1 except that the enclosed gas was changed to krypton gas and the controlling device 15 thereof produced a different pulse signal. From FIG. 9, it can be seen that, if the pulse duty ratio is reduced until it comes down to 5%, the relative life exhibits a little decreasing tendency, and after the pulse duty ratio is reduced beyond 5%, the life drops suddenly.

As apparently seen from FIGS. 7, 8 and 9, a rare gas discharge fluorescent lamp device which is high in efficiency and long in life can be obtained by applying between the electrodes 3*a* and 3*d* of the lamp thereof a pulse voltage wherein each cycle has an energization period and a deenergization period and the ratio of the energization period is higher than 5% but lower than 70% while the energization period in each cycle is shorter than 150 μsec.

Subsequently, several rare gas discharge fluorescent lamp devices of the same construction as described above were produced wherein the pressure of enclosed krypton gas was varied to various values, and the relationship of a lamp efficiency and a starting voltage to a pressure of enclosed krypton gas was investigated with the rare gas discharge fluorescent lamp devices. Such results as shown by a colid line curve A' in FIG. 10 and in FIG. 11 were obtained. It is to be noted that the rare gas discharge fluorescent lamp devices had quite similar construction to that of the rare gas discharge fluorescent lamp device described hereinabove with reference to FIG. 1 except that the enclosed gas was changed to krypton gas. It is also to be noted that a broken line curve B' in FIG. 10 shows, for comparison, a result of an investigation of a relationship between a pressure of enclosed krypton gas and a lamp efficiency in the case of high frequency ac lighting with a sine wave of a frequency of 20 KHz when a conventional rare gas discharge fluorescent lamp device having such construction as seen in FIG. 25 was used.

Figure 10:
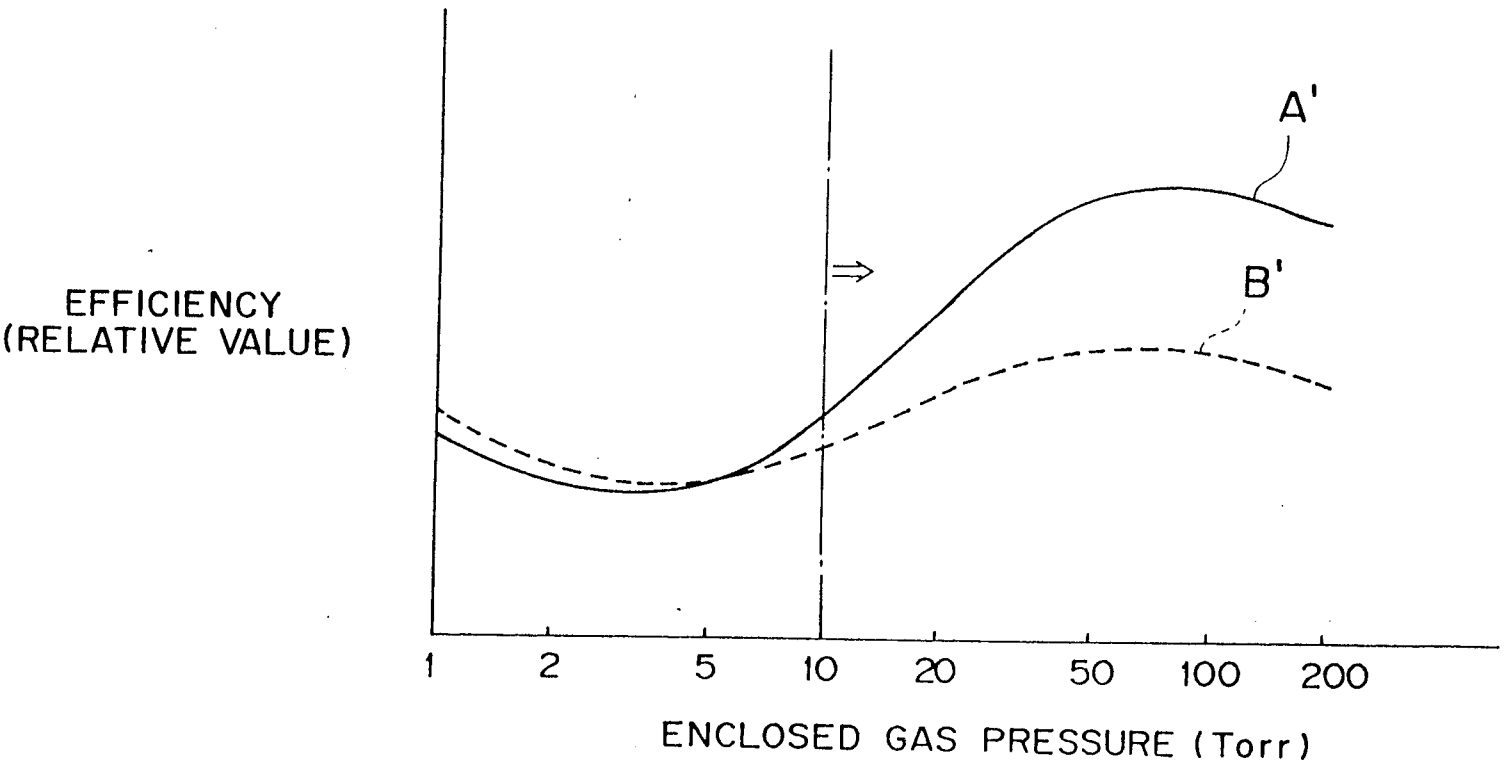
FIG. 10 is a diagram illustrating a relationship of an efficiency to an enclosed gas pressure when krypton gas is used with the device shown in FIG. 1.
Figure 11:
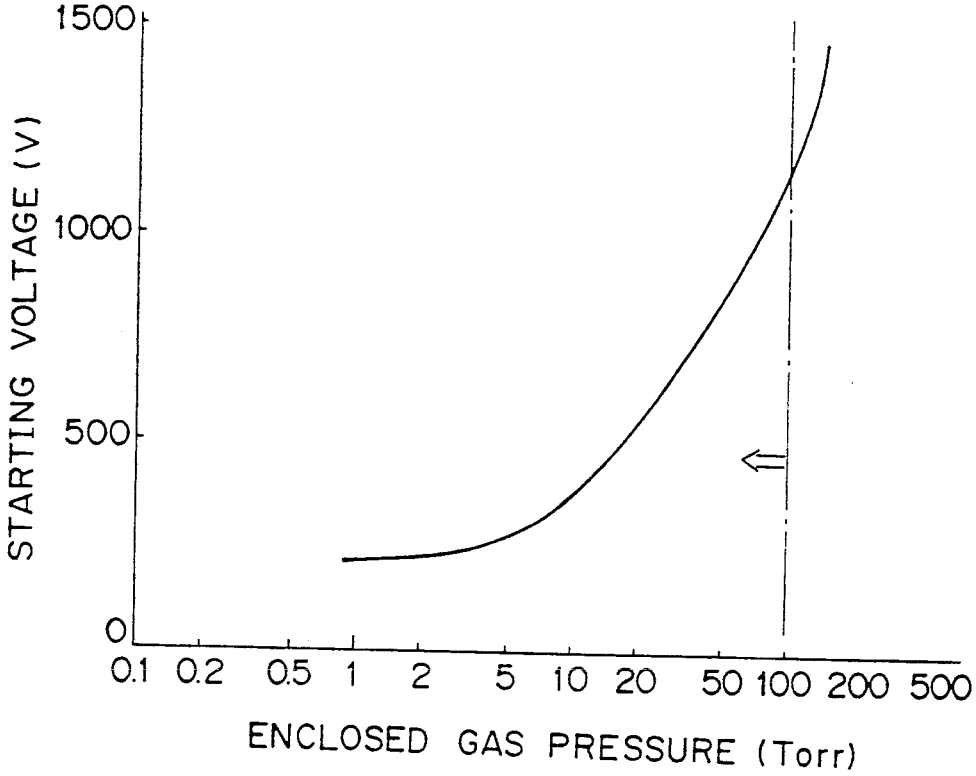
FIG. 11 is a diagram illustrating a relationship of a starting voltage to an enclosed gas pressure when krypton gas is used with the device shown in FIG. 1.

It can apparently be seen from FIG. 10 that, after the enclosed krypton gas pressure exceeds 5 Torr, the efficiency of the lamp begins to rise and presents a higher value than that of the conventional rare gas discharge fluorescent lamp device. Then, a maximum efficiency is presented within a range of several tens Torr of the enclosed krypton gas pressure. On the other hand, it can be seen from FIG. 11 that, as the enclosed krypton gas pressure increases, the starting voltage rises gradually, and after the enclosed xenon gas pressure exceeds 200 Torr, the starting voltage rises suddenly. Accordingly, the enclosed krypton gas pressure should be higher than 5 Torr but lower than 200 Torr, and preferably higher than 10 Torr but lower than 100 Torr, and most preferably higher than 20 Torr but lower than 100 Torr.

Further, various rare gas discharge fluorescent lamp devices of the construction shown in FIG. 1 were produced wherein argon gas was enclosed in the lamp in place of krypton gas, and various investigations were made, in a similar manner as in the case of xenon gas, of a relationship between an energization period and a lamp efficiency, a relationship between a pulse duty ratio and a lamp efficiency, a relationship between a pulse duty ratio and a relative life, and a relationship of a lamp efficiency and a starting voltage to a pressure of enclosed argon gas. Such results as shown in FIG. 12, by solid line curves D" and E" in FIG. 13, in FIG. 14, and by a solid line curve A" in FIG. 15 and in FIG. 16.

Figure 12:
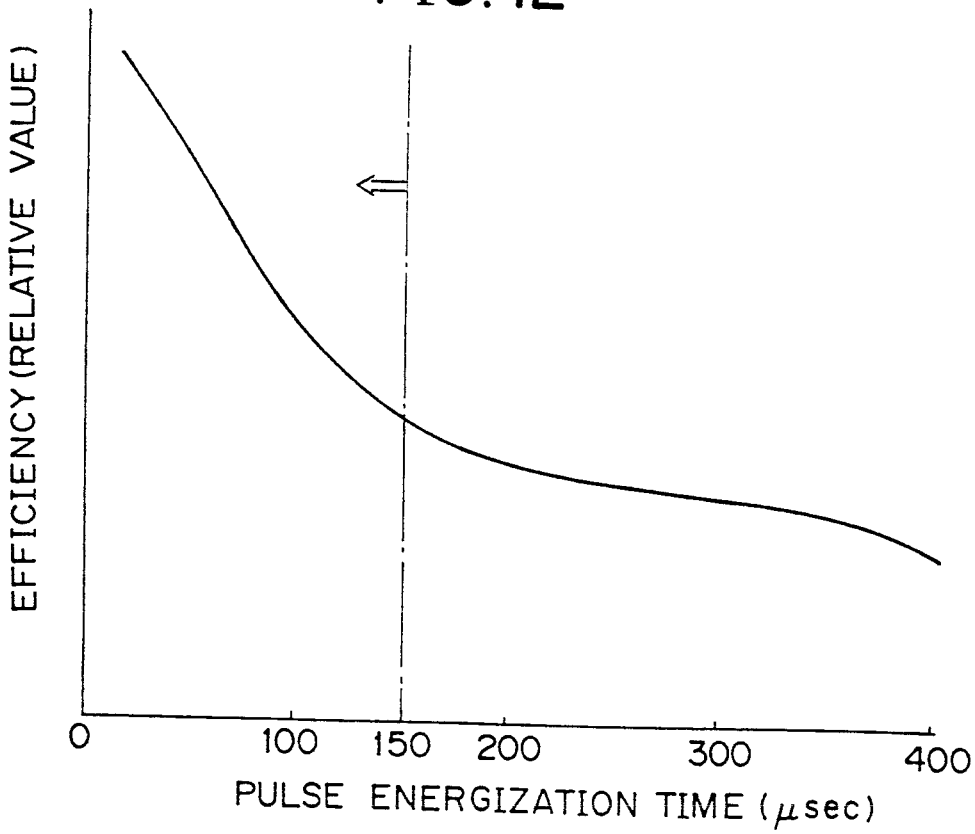
FIG. 12 is a diagram illustrating a relationship of a lamp efficiency to an energization time of a pulse when argon gas is used with the device shown in FIG. 1.
Figure 13:
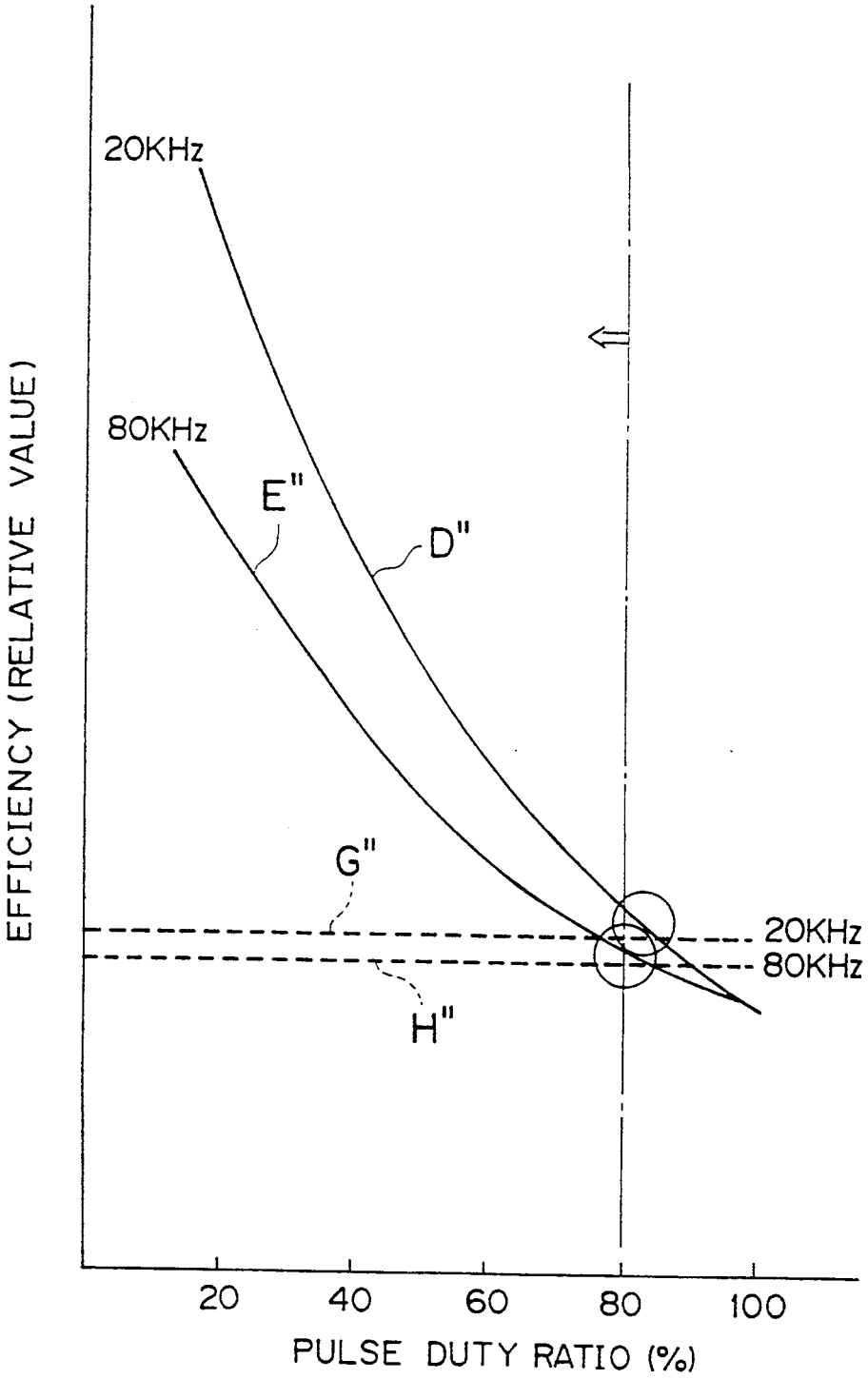
FIG. 13 is a diagram illustrating a relationship of a lamp efficiency to a pulse duty ratio when argon gas is used with the device shown in FIG. 1.
Figure 14:
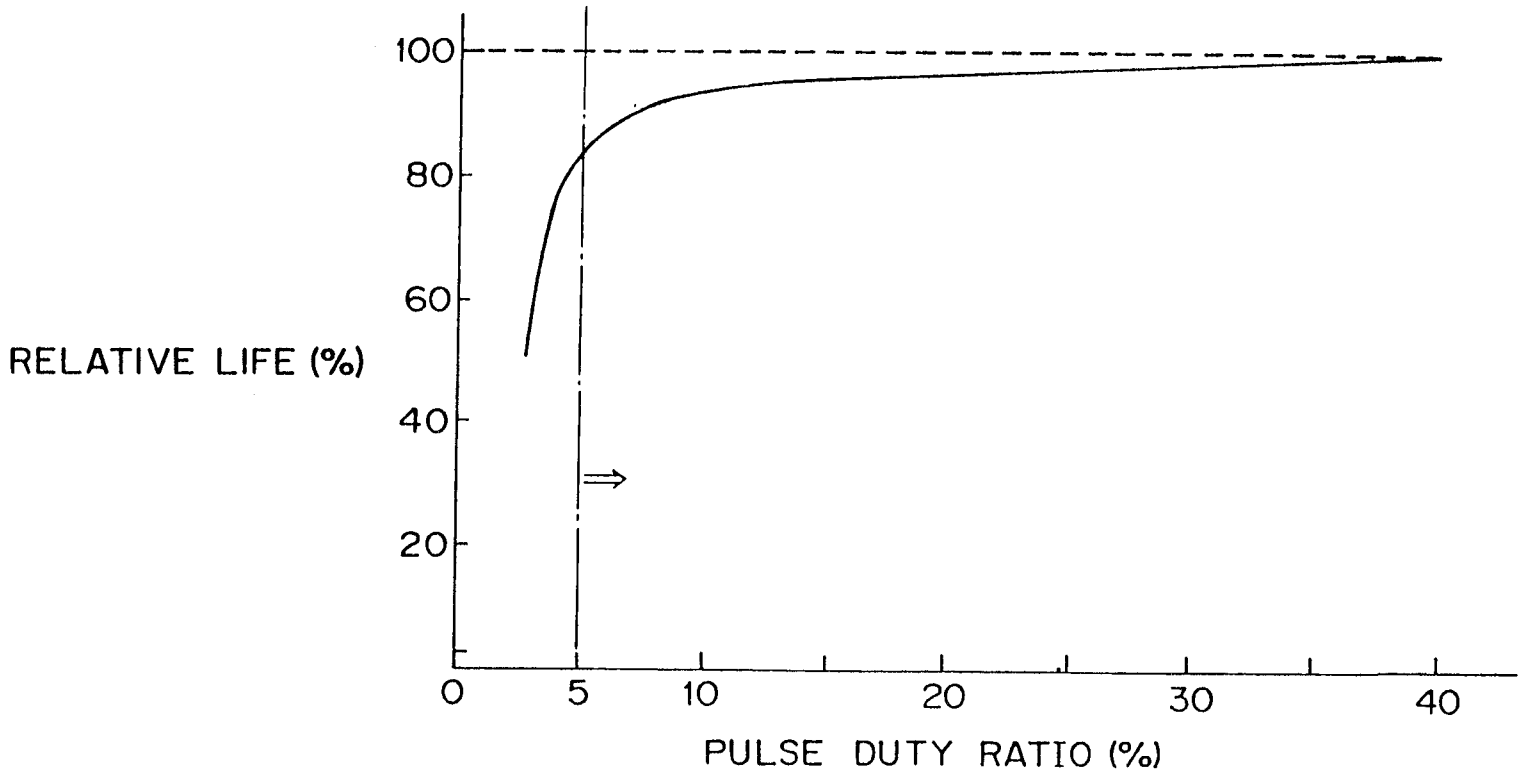
FIG. 14 is a diagram illustrating a relationship of a life to a pulse duty ratio when argon gas is used with the device shown in FIG. 1.

As apparently seen from FIGS. 12, 13 and 14, a rare gas discharge fluorescent lamp device which is high in efficiency and long in life can be obtained by applying between the electrodes 3*a* and 3*d* of the lamp thereof a pulse voltage wherein each cycle has an energization period and a deenergization period and the ratio of the energization period is higher than 5% and lower than 80% while the energization period in each cycle is shorter than 150 μsec.

Figure 15:
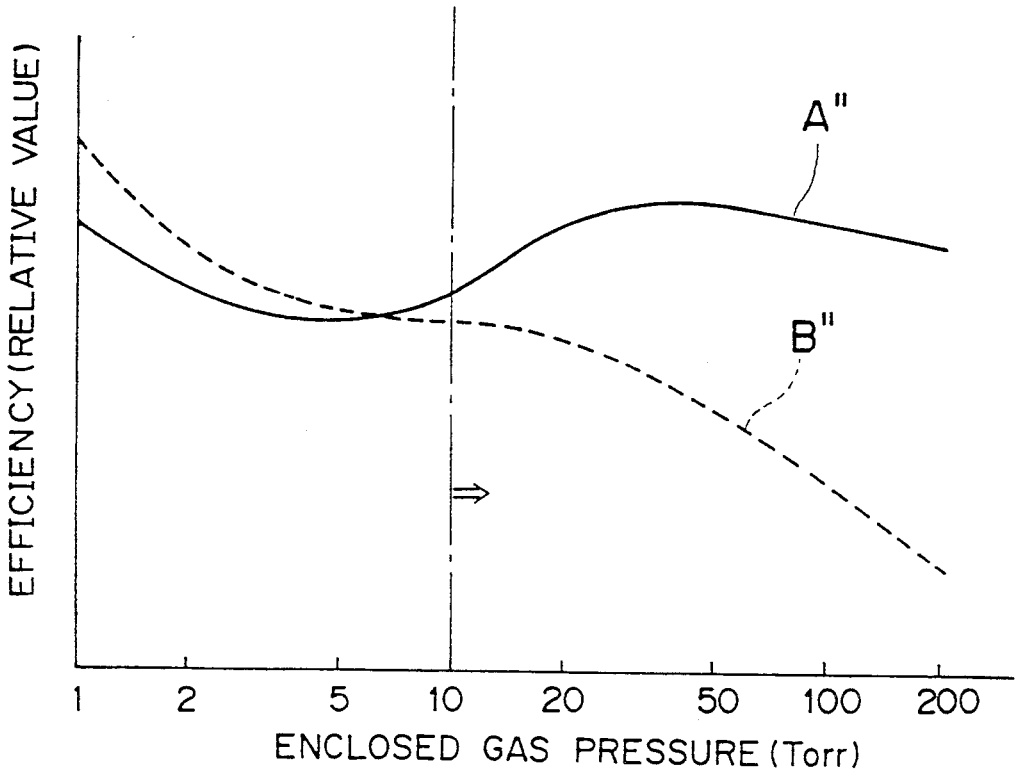
FIG. 15 is a diagram illustrating a relationship of an efficiency to an enclosed gas pressure when argon gas is used with the device shown in FIG. 1.
Figure 16:
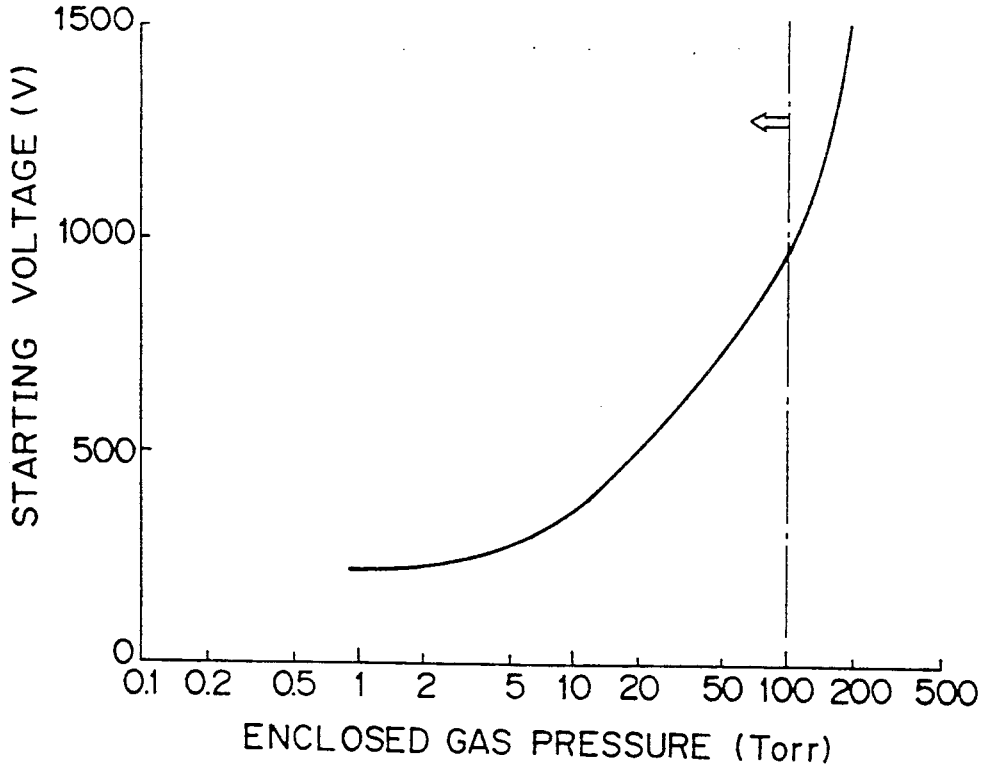
FIG. 16 is a diagram illustrating a relationship of a starting voltage to an enclosed gas pressure when argon gas is used with the device shown in FIG. 1.

Meanwhile, as apparently seen from FIGS. 15 and 16, the enclosed argon gas pressure should be higher than 10 Torr but lower than 200 Torr, and preferably higher than 10 Torr but lower than 100 Torr, and most preferably higher than 20 Torr but lower than 100 Torr.

It is to be noted that, while the rare gas discharge fluorescent lamp device of the construction shown in FIG. 1 employs a filament electrode for each of the electrodes 3*a* and 3*b* of the lamp thereof, the electrode 3*a* need not be a filament electrode because it serves as a positive terminal, and similar effects can be exhibited also with a rare gas discharge fluorescent lamp device which employs a cold cathode type lamp wherein a filament need not be pre-heated.

Further, while in the embodiment described hereinabove an inductor is employed as the current limiting element, similar effects can be exhibited even where a capacitor is employed as the current limiting element.

Further, while in the embodiment described hereinabove the outer diameter of the bulb 1 is 15.5 mm, an examination which was conducted with bulbs having diameters ranging from 8 mm to 15.5 mm proved that similar lamp efficiencies and lives could be obtained irrespective of the outer diameters.

Further, while description is given of the case wherein the gas enclosed in the bulb 1 is xenon gas, krypton gas or argon gas as simple substance, any mixture of such gases may be used as such enclosed gas, and any mixture with any other rare gas such as neon or helium proved similar effects.

Figure 17:
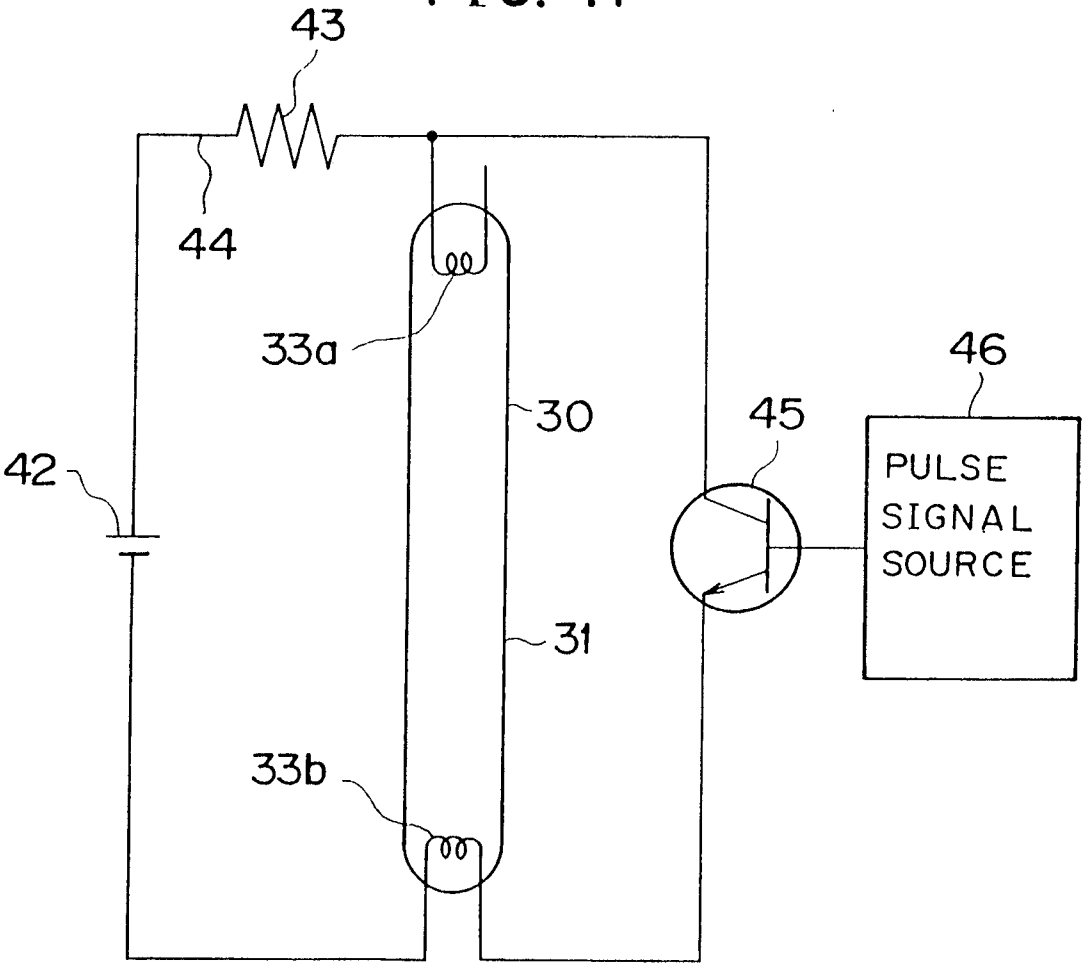
FIG. 17 is a diagrammatic representation of an entire construction of another rare gas discharge fluorescent lamp device showing a second embodiment of the present invention.

Referring now to FIG. 17, there is shown a rare gas discharge fluorescent lamp device according to a second embodiment of the present invention. The lamp device shown includes a rare gas discharge fluorescent lamp generally denoted at 30. The rare gas discharge fluorescent lamp 30 includes a bulb 31 in the form of a tube made of glass and having an outer diameter of 15.5 mm and an overall axial length of 300 mm. Xenon gas, krypton gas or argon gas is enclosed in the bulb 31. Though not shown, an auxiliary starting conductor in the form of an aluminum plate having a width of about 3 mm is provided in an axial direction on an outer face of the bulb 31 while a fluorescent layer is formed on a substantially entire inner face of the bulb 31. The lamp 30 further includes a pair of electrodes including a positive electrode 33*a* and a negative electrode 33*b* each formed from a filament coil to which an electron emitting substance is applied. The electrodes 33*a* and 33*b* are enclosed in the longitudinal opposite ends of the bulb 31.

The lamp device includes, in addition to the lamp described just above, a dc power source 42 and a current limiting element 43 in the form of a resistor connected in series to the dc power source 42. A series circuit 44 including the dc power source 42 and the current limiting element 43 is connected between the positive electrode 33*a* and an end of the negative electrode filament coil 33*b*. A switching element 45 in the form of a transistor or the like is connected between the positive electrode 33*a* of the lamp 40 and the other end of the negative electrode filament coil 33*b*. A pulse signal source 46 for generating a pulse signal for controlling the switching element 45 is connected to a control terminal of the transistor 45.

Operation of the rare gas discharge fluorescent lamp device of the construction described above is now described. In the rare gas discharge fluorescent lamp device, a dc voltage of the dc power source 42 is applied between the positive electrode 33*a* and the end of the negative electrode filament coil 33*b* of the lamp 30 connected to the dc power source 42 by way of the current limiting element 43 in the form of a resistor. However, since the switching element 45 is connected between the positive electrode 33*a* and the other end of the negative electrode filament coil 33*b* and is closed in each cycle and in a duration which depend upon a cycle and a pulse width of a pulse of a pulse signal from the pulse signal source 46, the voltage to be applied across the lamp 30 is cut off in each such duration while a current flows through the negative electrode filament coil 33*b* to pre-heat the negative electrode filament coil 33*b*. Consequently, a dc pulse voltage is applied across the lamp 30, and also discharge in the glass bulb 31 takes place in the form of pulses wherein a lamp current includes die periods in which the negative electrode 33*b* is pre-heated.

The rare gas discharge fluorescent lamp device of the present embodiment employs a hot cathode type lamp wherein the negative electrode is constituted from a filament coil. While a conventional lighting device for a hot cathode type lamp requires, in addition to a lighting power source, a pre-heating power source for pre-heating the negative electrode, the rare gas discharge fluorescent lamp device of the present embodiment eliminates the necessity of such pre-preheating power source because electric current flows through the filament coil of the negative electrode to heat the filament coil when the voltage applied to the lamp is in a die period. Accordingly, the rare gas discharge fluorescent lamp device is simplified in construction.

Figure 18:
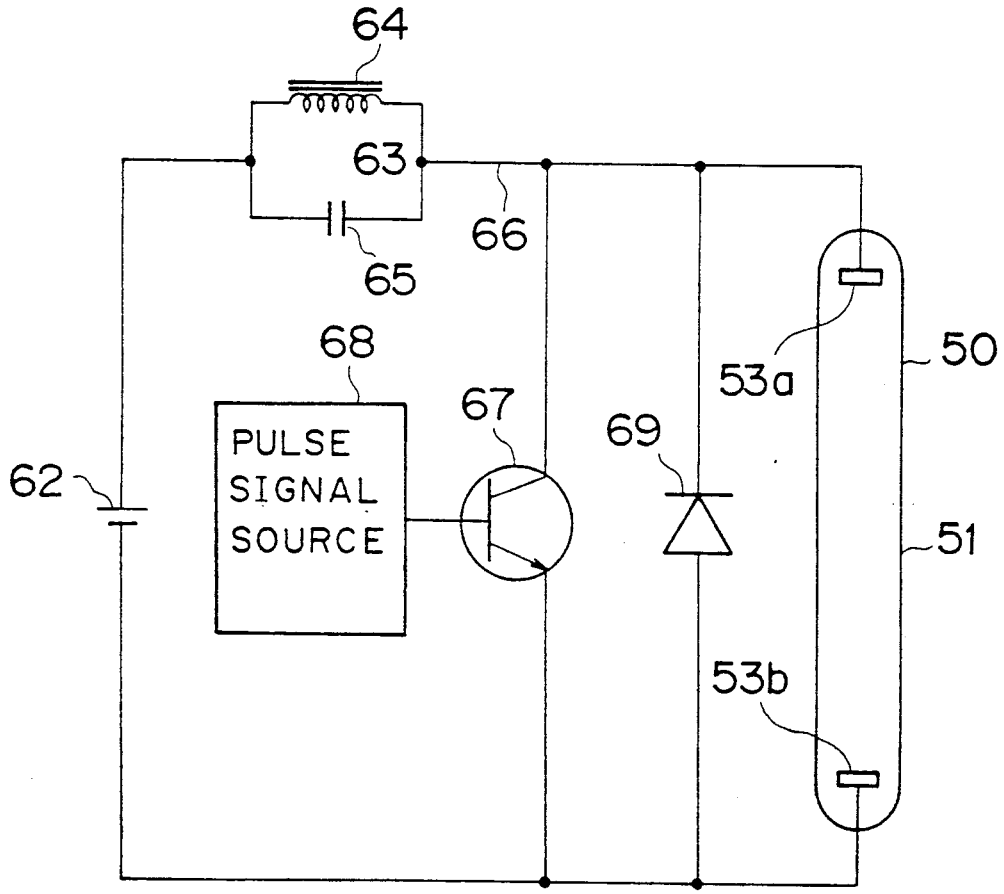
FIG. 18 is a diagrammatic representation of an entire construction of a further rare gas discharge fluorescent lamp device showing a third embodiment of the present invention.

Referring now to FIG. 18, there is shown a rare gas discharge fluorescent lamp device according to a third embodiment of the present invention. The lamp device shown includes a rare gas discharge fluorescent lamp generally denoted at 50. The rare gas discharge fluorescent lamp 50 includes a bulb 51 in the form of a tube made of glass and having an outer diameter of 15.5 mm and an overall axial length of 300 mm. Xenon gas, krypton gas or argon gas is enclosed in the bulb 51. Though not shown, an auxiliary starting conductor in the form of an aluminum plate having a width of about 3 mm is provided in an axial direction on an outer face of the bulb 51 while a fluorescent layer is formed on a substantially entire inner face of the bulb 51. The lamp 50 further includes a pair of electrodes 53*a* and 53*b* enclosed in the longitudinal opposite ends of the bulb 51.

The lamp device further includes a series circuit 66 consisting of a dc power source 62 and a parallel resonance circuit 63 which in turn consists of an inductor 64 and a capacitor 65. The lamp device further includes a switching element 67 in the form of a transistor or the like, a pulse signal source 68 connected to a control terminal of the transistor 65 for generating a pulse signal for controlling the switching element 65, and a diode 69. The series circuit 66, switching element 67 and diode 69 are all connected between the electrodes 53*a* and 53*b* of the lamp 50.

Operation of the rare gas discharge fluorescent lamp device is now described. In the rare gas discharge fluorescent lamp device, a dc voltage of the dc power source 62 is applied between the electrodes 53*a* and 53*b* of the lamp 50 by way of the parallel resonance circuit 63 consisting of the inductor 64 and capacitor 65. However, since the switching element 67 is connected between the electrodes 53*a* and 53*b* and is closed in each cycle and in a duration which depends upon a cycle and a pulse width of a pulse of a pulse signal from the pulse signal source 63, the voltage to be applied across the lamp 50 is cut off in each such duration. Accordingly, a dc pulse voltage which is produced by cutting off of the voltage to be applied across the lamp 50 is boosted by the resonance circuit 63 to a voltage necessary for the lighting of the lamp 50 to cause discharge of the lamp 50. Accordingly, discharge in the lamp 50 takes place in the form of pulses wherein a lamp current includes die periods. The pulse voltage applied to the lamp 50 does not present the form of a rectangular pulse voltage but has such a waveform as can be obtained by half-wave rectification of a substantially sinusoidal ac waveform. Accordingly, higher harmonic components at a rising edge of a pulse are moderated. Further, the diode 69 is connected so that the resonance circuit 63 may operate effectively.

Also, several rare gas discharge fluorescent lamp devices of the constructions described hereinabove with reference to FIGS. 17 and 18 were produced wherein various conditions were varied in a similar manner as in the case of rare gas discharge fluorescent lamp devices of the construction shown in FIG. 1. Investigations conducted for the rare gas discharge fluorescent lamp devices proved substantially similar results to those in the case of the rare gas discharge fluorescent lamp devices of the construction shown in FIG. 1 which are illustrated in FIGS. 2 to 16.

Figure 19:
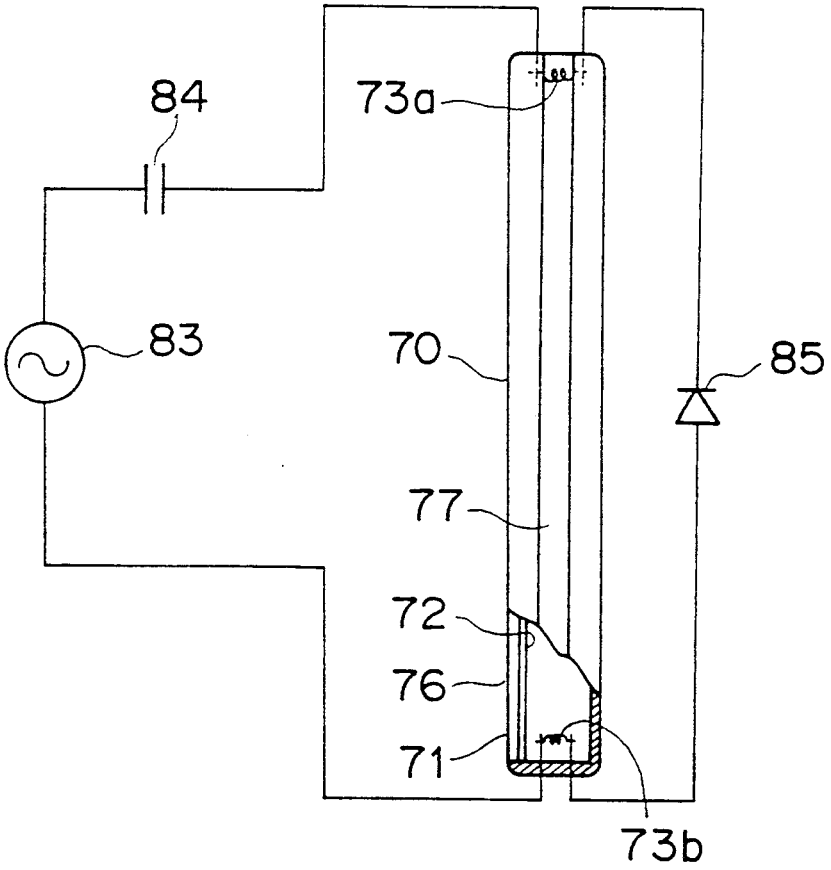
FIG. 19 is a diagrammatic representation of an entire construction of a still further rare gas discharge fluorescent lamp device showing a fourth embodiment of the present invention.

Referring now to FIG. 19, there is shown a rare gas discharge fluorescent lamp device according to a fourth embodiment of the present invention. The lamp device shown includes a rare gas discharge fluorescent lamp generally denoted at 70. The rare gas discharge fluorescent lamp 70 includes a glass bulb 71 in the form of a tube made of glass and having an outer diameter of 15.5 mm and an overall axial length of 300 mm. Xenon gas is enclosed in the bulb 71. A fluorescent layer 72 is formed on an inner face of the bulb 71 while a reflecting film 76 is formed on an outer periphery of the bulb 71 with a narrow axial slit 12 left therein. The lamp 70 further includes first and second electrodes 73*a* and 73*b* each in the form of a filament electrode which has a pair of ends and to which an electron reflecting substance is applied. The first and second electrodes 73*a* and 73*b* are provided at the longitudinal opposite ends of the bulb 71.

The lamp device further includes a high frequency power source 83 having an output end connected to one of the pair of ends of the second electrode 73*b* of the lamp 70. A current limiting element 84 in the form of a capacitor is connected between the other output end of the high frequency power source 83 and one of the pair of ends of the first electrode 73*a* of the lamp 70. The high frequency power source 83 and current limiting element 84 generally constitute a high frequency power generating source for providing to the first and second electrodes 73*a* and 73*b* of the lamp 70 a high frequency power having a frequency of 20 KHz and a constant output power of 7 w. The lamp device further includes a rectifying element 85 in the form of a diode connected between the other ends of the first and second electrodes 73*a* and 73*b* of the lamp 70.

Operation of the rare gas discharge fluorescent lamp device of the construction described above is described subsequently. First, when a high frequency power having a frequency of 20 KHz is delivered from the high frequency power source 83, it is applied between the ends of the first and second electrodes 73*a* and 73*b* connected to the current limiting element 84 and the power source 83, respectively, while a current flow is limited by the current limiting element 84. When the high frequency power presents a positive potential on the first electrode 73*a* side of the lamp 70, no current will flow through the rectifying element 85 while the high frequency power is applied between the first and second electrodes 73*a* and 73*b* of the lamp 70. Consequently, glow discharge will appear between the first and second electrodes 73*a* and 73*b* and excites the xenon gas within the bulb 71 to produce ultraviolet rays peculiar to xenon gas. Such ultraviolet rays are converted into visible rays of light by the fluorescent layer 72 formed on the inner face of the bulb 71 and radiated as irradiation light of visible rays of light of a narrow cross section from the reflecting film 76 through the slit 77 to the outside of the bulb 1.

On the other hand, when the high frequency power presents a negative potential on the first electrode 73*a* side, it applies a voltage in the forward direction across the rectifying element 85. Consequently, the first and second electrodes 73*a* and 73*b* of the lamp 70 are short-circuited, and accordingly, electric current flows from the high frequency power source 83 by way of the adjacent end and then the other end of the second electrode 73*b*, the rectifying element 85, the adjacent end and then the other end of the first electrode 73*a* and the current limiting element 84 back to the high frequency power source 83. In this instance, electric current flows through the filament of the second electrode 73*b* of the lamp 70 to pre-heat the second electrode 73. As a result, discharge can be obtained in a high efficiency and brightness.

In summary, with the rare gas discharge fluorescent lamp device of the present embodiment, when a half-wave rectified voltage of a high frequency power is applied between the first and second electrodes 73*a* and 73*b* of the lamp 70, discharge takes place, but when another reverse half-wave rectified voltage is applied, the second electrode 74*b* which now acts as a negative electrode is pre-heated, which is different from discharge in ordinary high frequency lighting. In short, pulse-like discharge takes place wherein the lamp current has a die period.

Subsequently, several rare gas discharge fluorescent lamp devices of such construction as described just above were produced wherein the pressure of enclosed xenon gas was varied to various values, and the relationship of a lamp efficiency (a value obtained by dividing a brightness by a power, a relative value) to a pressure of enclosed xenon gas was investigated with the rare gas discharge fluorescent lamp devices. Such a result as shown by a solid line curve J1 in FIG. 20 was obtained. It is to be noted that the rare gas discharge fluorescent lamp devices had quite similar construction to that of the rare gas discharge fluorescent lamp device described hereinabove with reference to FIG. 19 except that the pressure of enclosed xenon gas was varied. It is also to be noted that a broken line curve K1 in FIG. 20 shows, for comparison, a result of an investigation of a relationship between a pressure of enclosed xenon gas and a lamp efficiency when a conventional rare gas discharge fluorescent lamp device was used which had such construction as seen in FIG. 25 except that the lamp had no such an external electrode as the external electrode 105.

Figure 20:
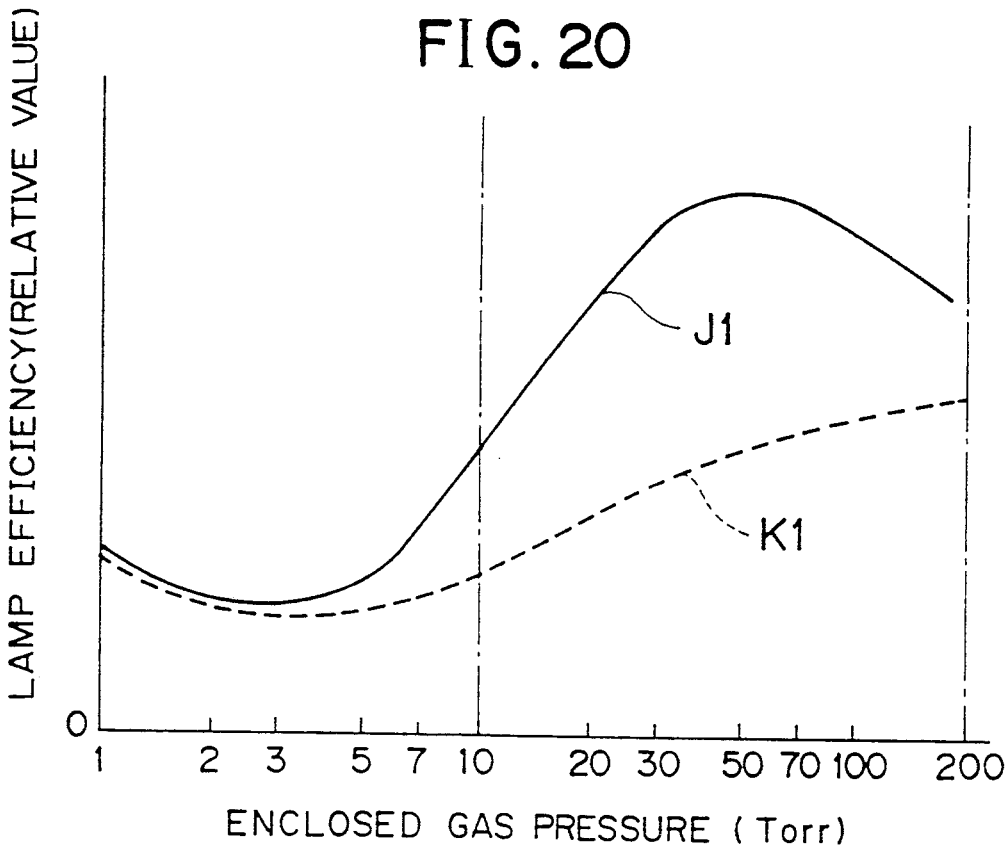
FIG. 20 is a diagram illustrating a relationship of a lamp efficiency to an enclosed gas pressure when xenon gas is used with the device shown in FIG. 19.

It can apparently be seen from FIG. 20 that, after the enclosed xenon gas pressure exceeds 5 Torr, the efficiency of the lamp begins to rise and presents a higher value than that of the conventional rare gas discharge fluorescent lamp device. Then, a maximum efficiency is presented within a range of several tens Torr of the enclosed xenon gas pressure. Accordingly, the enclosed xenon gas pressure should be higher than 5 Torr but lower than 200 Torr, and preferably higher than 10 Torr but lower than 200 Torr, and most preferably higher than 20 Torr but lower than 100 Torr.

It can be considered that such improvement in lamp efficiency when the enclosed xenon gas pressure is higher than 5 Torr but lower than 200 Torr arises from the following reason. In particular, pulse-like discharge wherein an energization period and a die period alternatively appear between the first and second electrodes 73*a* and 73*b* of the lamp 70 modulates electron energy of a positive column produced in the bulb 71 to a high degree to increase the energy to excite the xenon gas so as to increase ultraviolet rays to be generated from the xenon gas, and also after glow light is emitted during such die periods. When the enclosed xenon gas pressure is lower than 5 Torr, no after glow is emitted during die periods, but after the enclosed xenon gas pressure exceeds 10 Torr, emission of after glow during die periods appears remarkably. However, if the enclosed xenon gas pressure presents such a high value above 200 Torr, then the electron energy is restrained by frequent collisions of excited high energy electrons with xenon gas, and consequently, the electron energy is not modulated readily by pulses and the lamp efficiency is deteriorated.

Further several rare gas discharge fluorescent lamp devices of the same construction were produced wherein the lighting frequency (frequency of the high frequency power source 83) was varied to various values, and the relationship between a lighting frequency and a lamp efficiency (relative value) was investigated with the rare gas discharge fluorescent lamp devices. Such a result as shown by a solid line curve L1 in FIG. 21 was obtained.

Figure 21:
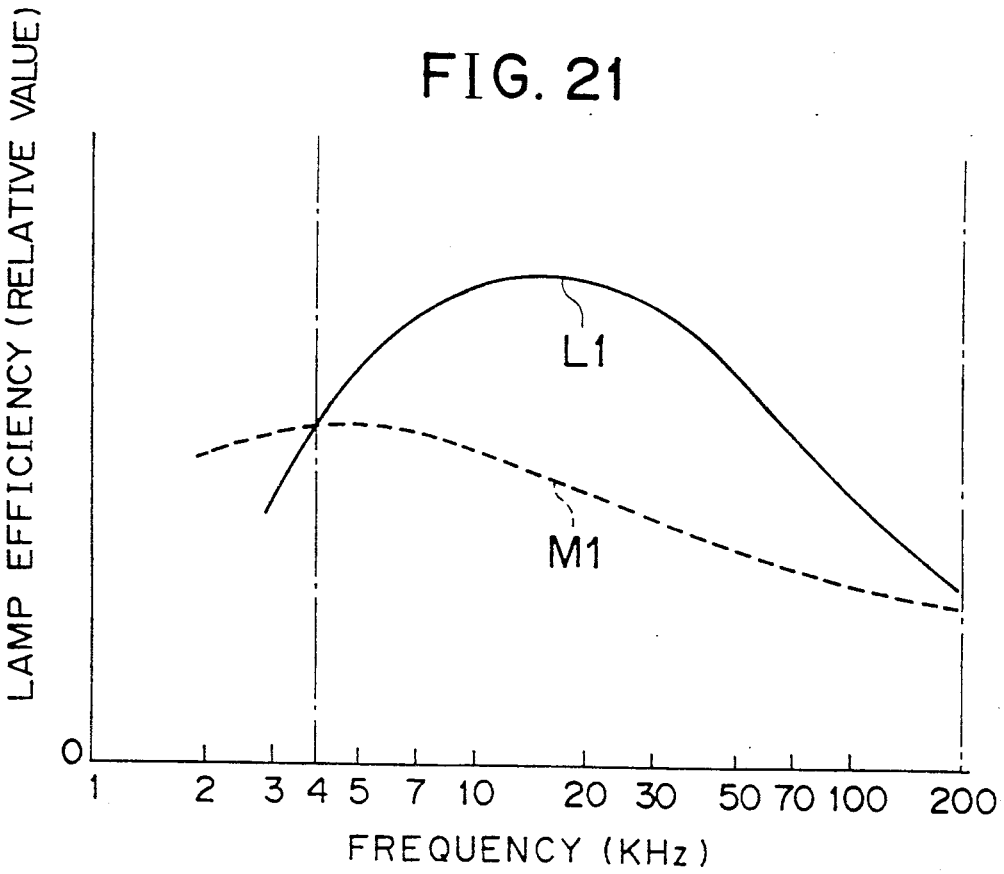
FIG. 21 is a diagram illustrating a relationship of a lamp efficiency to a lighting frequency when xenon gas is used with the device shown in FIG. 19.

It is to be noted that the rare gas discharge fluorescent lamp devices had quite similar construction to that of the rare gas discharge fluorescent lamp device shown in FIG. 19, and a broken line curve M1 in FIG. 21 shows, for comparison, a result of an investigation of a relationship between a lighting frequency and a lamp efficiency when such conventional rare gas discharge fluorescent lamp device as described hereinabove in connection with FIG. 20 was used.

It can apparently be seen from FIG. 21 that, after the lighting frequency exceeds 4 KHz, the lamp efficiency begins to rise and presents a higher value than that of the conventional rare gas discharge fluorescent lamp device. Then, a maximum efficiency is presented around a lighting frequency of 20 KHz. Accordingly, the lighting frequency should be higher than 4 KHz but lower than 200 KHz, and preferably higher than 7 KHz but lower than 50 KHz, and most preferably higher than 10 KHz but lower than 30 KHz.

It can be considered that the efficiency is improved within the range of the lighting frequency higher than 4

KHz but lower than 200 KHz from the following reason. In short, where the lighting frequency is lower than 4 KHz, the die period in one cycle is so long that the lamp efficiency is deteriorated, but where the lighting frequency exceeds 200 KHz, a plasma parameter of a positive column produced in the bulb 71 cannot follow up the lighting frequency and approaches a fixed condition as in direct current so that the lamp efficiency is deteriorated. Consequently, it is considered that the lighting frequency should be higher than 4 KHz but lower than 200 KHz.

Further, several rare gas discharge fluorescent lamp devices of the same construction were produced wherein krypton gas was enclosed in the tube 71 of the lamp 70 in place of xenon gas. First, several rare gas discharge fluorescent lamp devices of the same construction as that shown in FIG. 19 were produced except that krypton gas was used as the enclosed gas and was varied to various values, and the relationship between a pressure of enclosed krypton gas and a lamp efficiency (relative value) was investigated with the rare gas discharge fluorescent lamp devices. Such a result as shown by a solid line curve J2 in FIG. 22 was obtained. Further, several rare gas discharge fluorescent lamp devices of the same construction were produced except that the pressure of enclosed krypton gas was set to 30 Torr and the lighting frequency was varied, and the relationship between a lighting frequency and a lamp efficiency (relative value) was investigated with the rare gas discharge fluorescent lamp devices. Such a result as shown by a solid line curve L2 in FIG. 23 was obtained. It is to be noted that broken line curves K2 and M2 in FIGS. 22 and 23 show, for comparison, results of investigations of relationships of a lamp efficiency to an enclosed gas pressure and a lighting frequency, respectively, when such conventional rare gas discharge fluorescent lamp device as described hereinabove in connection with FIG. 20 was used.

Figure 22:
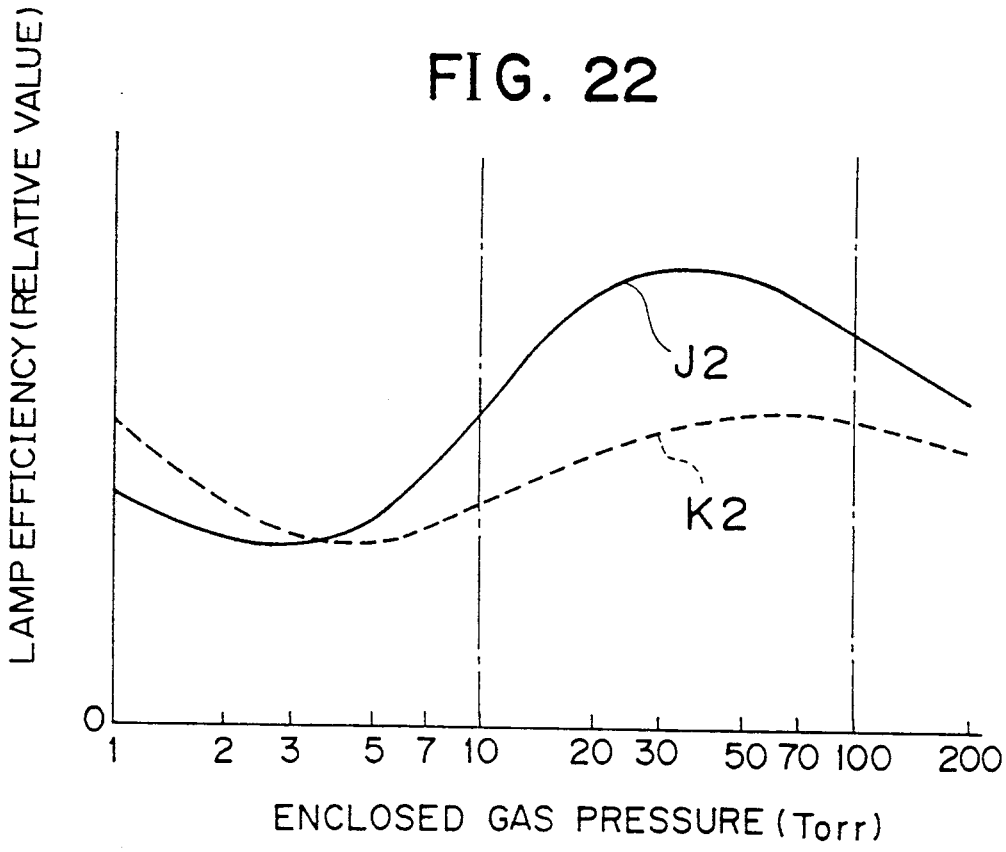
FIG. 22 is a diagram illustrating a relationship of a lamp efficiency to an enclosed gas pressure when krypton is used with the device shown in FIG. 1.
Figure 23:
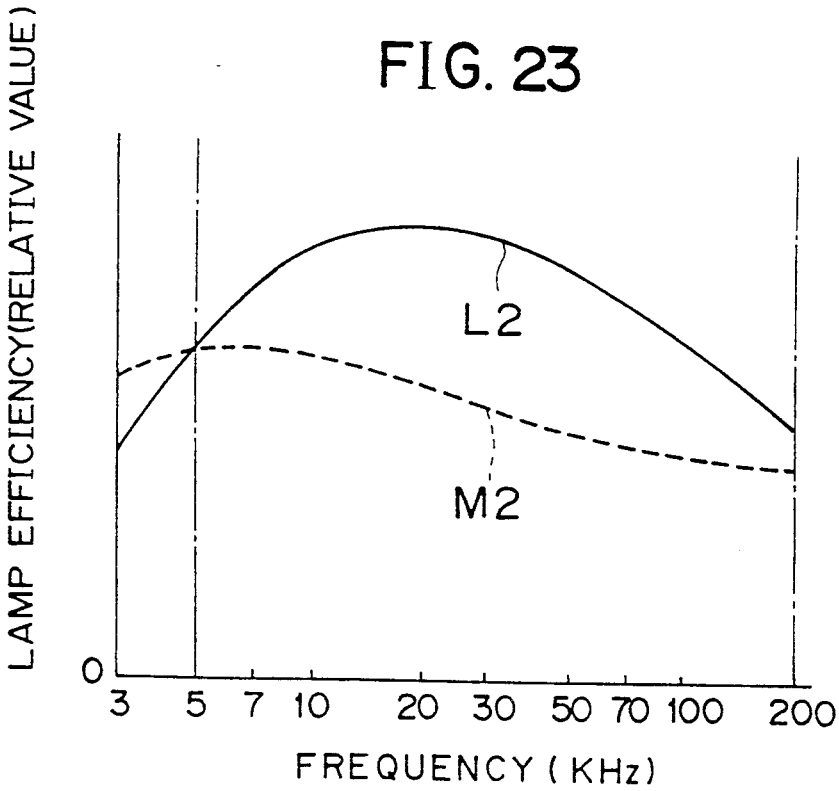
FIG. 23 is a diagram illustrating a relationship of a lamp efficiency to a lighting frequency when krypton is used with the device shown in FIG. 1.

It can apparently be seen from FIGS. 22 and 23 that, in order to assure a high lamp efficiency, the pressure of enclosed krypton gas should be higher than 5 Torr but lower than 200 Torr, and preferably higher than 10 Torr but lower than 100 Torr, and most preferably higher than 20 Torr but lower than 50 Torr, while the lighting frequency should be higher than 5 KHz but lower than 200 KHz, and preferably higher than 7 KHz but lower than 100 KHz, and most preferably higher than 10 KHz but lower than 50 KHz. It can be considered that the reason why the lamp efficiency is improved in this manner also where krypton gas is used as enclosed rare gas is similar to that where xenon gas is used as rare gas.

In this manner, with the rare gas discharge fluorescent lamp device having such a construction as shown in FIG. 19, the lamp efficiency can be improved significantly as can be apparently seen from FIGS. 20 to 23 and such improvement can be achieved by simple construction that a rectifying element is additionally provided. Accordingly, the lighting device is so simplified in construction that it can be realized readily at a reduced cost. Besides, since electric current flows through the second electrode 73*b* of the lamp 70 in the form of a filament electrode serving as a negative electrode during a die period, a power source for the preheating is not required. Further, since a capacitor is employed as the current limiting element 84, the power loss of the lighting device is low. Besides, since a voltage equal to twice as much as that of the high frequency power source 83 is generated by the combination of the rectifying element 85 and the capacitor serving as the current limiting element 84 and is applied between the pair of electrodes 73*a* and 73*b* of the lamp 70, a high voltage required for starting of discharge can be obtained readily. In addition, since the discharge current can have a waveform which has a moderate rising feature in the form of a half-wave rectified sine wave, higher harmonic wave components are reduced and electromagnetic noises which make a problem in pulse discharge are also reduced.

Figure 24:
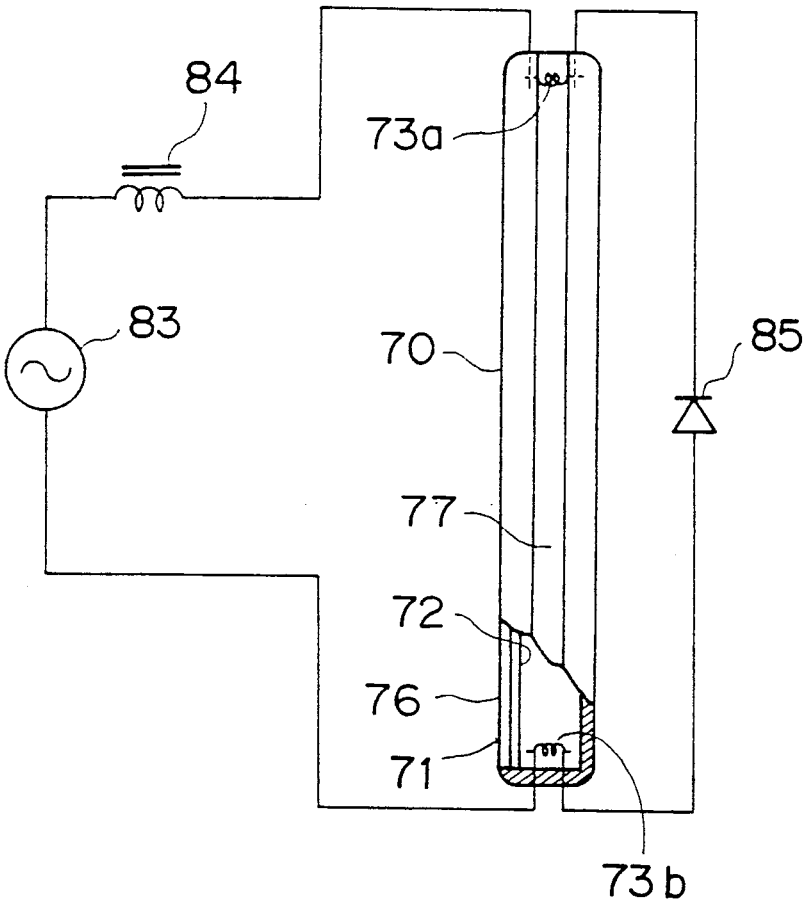
FIG. 24 is a diagrammatic representation of an entire construction of a yet further rare gas discharge fluorescent lamp device showing a fifth embodiment of the present invention.

Referring now to FIG. 24, there is shown a modification to the rare gas discharge fluorescent lamp device shown in FIG. 19. The modified rare gas discharge fluorescent lamp device is only different in that an inductor is used as the current limiting element 84 in place of a capacitor.

Also with the modified rare gas discharge fluorescent lamp device, where xenon gas was enclosed in the bulb 71 of the lamp 70, similar characteristics to those shown by the solid line curves J1 and L1 in FIGS. 20 and 21 were obtained. Meanwhile, where krypton gas was enclosed in the bulb 71, similar characteristics to those shown by the solid line curves J2 and L2 in FIGS. 22 and 23 were obtained.

It is to be noted that, while the rare gas discharge fluorescent lamp devices shown in FIGS. 19 and 24 employ a filament electrode for each of the first and second electrodes 73*a* and 73*b* of the lamp 70, since the first electrode 73*a* serves as a positive electrode while the second electrode 73*b* serves as a negative electrode due to presence of the rectifying element 85, the first electrode 73*a* serving as a positive electrode need not be pre-heated, and consequently, the opposite ends of the first electrode 73*a* may be short-circuited or else the first electrode 73*a* need not be formed particularly as a filament electrode.

Further, while the bulb 71 of the lamp 70 has an outer diameter of 15.5 mm, an investigation which was conducted with such bulbs having outer diameters ranging from 8 mm to 15.5 mm revealed that similar improvement in efficiency was obtained irrespective of the diameters of the lamp bulbs.

Further, while description is given of the case wherein the gas enclosed in the bulb 1 is xenon gas, krypton gas or argon gas as simple substance, any mixture of such gases may be used as such enclosed gas, and any mixture with any other rare gas such as neon or helium proved similar effects.

Having now fully described the invention, it will be apparent to one of ordinary skill in the art that many changes and modifications can be made thereto without departing from the spirit and scope of the invention as set forth herein.

What is claimed is:

1. A rare gas discharge fluorescent lamp device, comprising a rare gas discharge fluorescent lamp including a glass bulb having xenon gas or krypton gas enclosed therein, a fluorescent layer formed on an inner face of said glass bulb, and a pair of electrodes located at the opposite ends of said glass bulb, and a pulse-like voltage generating source for applying between said pair of electrodes of said rare gas discharge fluorescent lamp a pulse-like voltage wherein the ratio of an energization period with respect to one cycle is higher than 5% but lower than 70% and the energization period is shorter than 150 μsec, said pulse-like voltage generating source including a dc power source, a boosting transformer including a secondary coil connected between said pair of electrodes of said rare gas discharge fluorescent lamp and a primary coil having one of the opposite ends thereof connected to one of the opposite ends of said dc power source, a switching element connected between the other end of said primary coil of said boosting transformer and the other end of said dc power source, and controlling means for controlling said switching element between a conducting state and a non-conducting state.

2. A rare gas discharge fluorescent lamp device as claimed in claim 1, wherein xenon gas is enclosed in said glass bulb at a pressure higher than 10 Torr but lower than 200 Torr.

3. A rare gas discharge fluorescent lamp device as claimed in claim 1, wherein krypton gas is enclosed in said glass bulb at a pressure higher than 10 Torr but lower than 100 Torr.

4. A rare gas discharge fluorescent lamp device as claimed in claim 1, wherein said pulse-like voltage generating source further includes a capacitor connected in parallel to said primary coil of said boosting transformer to constitute a resonance circuit.

5. A rare gas discharge fluorescent lamp device as claimed in claim 1, wherein said pulse-like voltage generating source further includes a current limiting element in the form of an inductor or a capacitor connected between said secondary coil of said boosting transformer and one of said pair of electrodes of said rare gas discharge fluorescent lamp.

6. A rare gas discharge fluorescent lamp device as claimed in claim 1, wherein at least one of said pair of electrodes of said rare gas discharge fluorescent lamp is formed from a filament coil having a pair of ends, and further comprising a rectifying element connected between one of said ends of said filament coil and the other electrode.

7. A rare gas discharge fluorescent lamp device as claimed in claim 6, further comprising a capacitor connected between the other end of said filament coil and the other electrode for allowing said filament coil to be pre-heated.

8. A rare gas discharge fluorescent lamp device, comprising a rare gas discharge fluorescent lamp including a glass bulb having argon gas enclosed therein, a fluorescent layer formed on an inner face of said glass bulb, and a pair of electrodes located at the opposite ends of said glass bulb, and a pulse-like voltage generating source for applying between said pair of electrodes of said rare gas discharge fluorescent lamp a pulse-like voltage wherein the ratio of an energization period with respect to one cycle is higher than 5% but lower than 80% and the energization period is shorter than 150 μsec, said pulse-like voltage generating source including a dc power source, a boosting transformer including a secondary coil connected between said pair of electrodes of said rare gas discharge fluorescent lamp and a primary coil having one of the opposite ends thereof to one of the opposite ends of said dc power source, a switching element connected between the other end of said primary coil of said boosting transformer and the other end of said dc power source, and controlling means for controlling said switching element between a conducting state and a non-conducting state.

9. A rare gas discharge fluorescent lamp device as claimed in claim 8, wherein argon gas is enclosed in said glass bulb at a pressure higher than 10 Torr but lower than 100 Torr.

10. A rare gas discharge fluorescent lamp device as claimed in claim 8, wherein said pulse-like voltage generating source further includes a capacitor connected in parallel to said primary coil of said boosting transformer to constitute a resonance circuit.

11. A rare gas discharge fluorescent lamp device as claimed in claim 8, wherein said pulse-like voltage generating source further includes a current limiting element in the form of an inductor or a capacitor connected between said secondary coil of said boosting transformer and one of said pair of electrodes of said rare gas discharge fluorescent lamp.

12. A rare gas discharge fluorescent lamp device as claimed in claim 8, wherein at least one of said pair of electrodes of said rare gas discharge fluorescent lamp is formed from a filament coil having a pair of ends, and further comprising a rectifying element connected between one of said ends of said filament coil and the other electrode.

13. A rare gas discharge fluorescent lamp device as claimed in claim 12, further comprising a capacitor connected between the other end of said filament coil and the other electrode for allowing said filament coil to be pre-heated.

14. A rare gas discharge fluorescent lamp device, comprising a rare gas discharge fluorescent lamp including a glass bulb having xenon gas or krypton gas enclosed therein, a fluorescent layer formed on an inner face of said glass bulb, and a pair of electrodes located at the opposite ends of said glass bulb and serving as a negative electrode and a positive electrode, at least said negative electrode of said electrodes being formed from a filament coil, a series circuit including a dc power source and a current limiting element connected between said positive electrode of said rare gas discharge fluorescent lamp and one of the opposite ends of said filament coil of said negative electrode, a switching element connected between said positive electrode of said rare gas discharge fluorescent lamp and the other end of said filament coil of said negative electrode, and a pulse signal source for applying to said switching element a pulse signal to open said switching element for a period of time shorter than 150 μsec for each cycle at a ratio higher than 5% but lower than 70% with respect to one cycle.

15. A rare gas discharge fluorescent lamp device as claimed in claim 14, wherein xenon gas is enclosed in said bulb at a pressure higher than 10 Torr but lower than 200 Torr.

16. A rare gas discharge fluorescent lamp device as claimed in claim 14, wherein krypton gas is enclosed in said glass bulb at a pressure higher than 10 Torr but lower than 100 Torr.

17. A rare gas discharge fluorescent lamp device as claimed in claim 14, wherein said current limiting element is a resistor.

18. A rare gas discharge fluorescent lamp device, comprising a rare gas discharge fluorescent lamp including a glass bulb having argon gas enclosed therein, a fluorescent layer formed on an inner face of said glass bulb, and a pair of electrodes located at the opposite ends of said glass bulb and serving as a negative electrode and a positive electrode, at least said negative electrode of said electrodes being formed from a filament coil, a series circuit including a dc power source and a current limiting element connected between said positive electrode of said rare gas discharge fluorescent lamp and one of the opposite ends of said filament coil of said negative electrode, a switching element connected between said positive electrode of said rare gas discharge fluorescent lamp and the other end of said filament coil of said negative electrode, and a pulse signal source for applying to said switching element a pulse signal to open said switching element for a period of time shorter than 150 μsec for each cycle at a ratio higher than 5% but lower than 80% with respect to one cycle.

19. A rare gas discharge fluorescent lamp device as claimed in claim 18, wherein argon gas is enclosed in said glass bulb at a pressure higher than 10 Torr but lower than 100 Torr.

20. A rare gas discharge fluorescent lamp device as claimed in claim 18, wherein said current limiting element is a resistor.

21. A rare discharge fluorescent lamp device, comprising a rare gas discharge fluorescent lamp including a glass bulb having xenon gas or krypton gas enclosed therein, a fluorescent layer formed on an inner face of said glass bulb, and a pair of electrodes located at the opposite ends of said glass bulb, a series circuit connected between said electrodes of said rare gas discharge fluorescent lamp and including a dc power source and a resonance circuit which includes an inductor and a capacitor, a switching element connected between said electrodes of said rare gas discharge fluorescent lamp, and a pulse signal source for applying to said switching element a pulse signal to open said switching element for a period of time shorter than 150 μsec for each cycle at a ratio higher than 5% but lower than 70% with respect to one cycle.

22. A rare gas discharge fluorescent lamp device as claimed in claim 21, wherein xenon gas is enclosed in said glass bulb at a pressure higher than 10 Torr but lower than 200 Torr.

23. A rare gas discharge fluorescent lamp device as claimed in claim 21, wherein krypton gas is enclosed in said glass bulb at a pressure higher than 10 Torr but lower than 100 Torr.

24. A rare gas discharge fluorescent lamp device as claimed in claim 21, further comprising a diode connected between said pair of electrodes of said rare gas discharge fluorescent lamp.

25. A rare gas discharge fluorescent lamp device, comprising a rare gas discharge fluorescent lamp including a glass bulb having argon gas enclosed therein, a fluorescent layer formed on an inner face of said glass bulb, and a pair of electrodes located at the opposite ends of said glass bulb, a series circuit connected between said electrodes of said rare gas discharge fluorescent lamp and including a dc power source and a resonance circuit which includes an inductor and a capacitor, a switching element connected between said electrodes of said rare gas discharge fluorescent lamp, and a pulse signal source for applying to said switching element a pulse signal to open said switching element for a period of time shorter than 150 μsec for each cycle at a ratio higher than 5% but lower than 80% with respect to one cycle.

26. A rare gas discharge fluorescent lamp device as claimed in claim 25, wherein argon gas is enclosed in said glass bulb at a pressure higher than 10 Torr but lower than 100 Torr.

27. A rare gas discharge fluorescent lamp device as claimed in claim 25, further comprising a diode connected between said pair of electrodes of said rare gas discharge fluorescent lamp.

* * * * *